US011397386B2

(12) United States Patent
Kyuushima et al.

(10) Patent No.: US 11,397,386 B2
(45) Date of Patent: Jul. 26, 2022

(54) TONER AND TONER MANUFACTURING METHOD

(71) Applicant: CANON KABUSHIKI KAISHA, Tokyo (JP)

(72) Inventors: Hirofumi Kyuushima, Numazu (JP); Yoshiaki Shiotari, Mishima (JP); Shintaro Noji, Mishima (JP); Mai Kato, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 36 days.

(21) Appl. No.: 16/871,176

(22) Filed: May 11, 2020

(65) Prior Publication Data

US 2020/0363742 A1 Nov. 19, 2020

(30) Foreign Application Priority Data

May 13, 2019 (JP) ..... JP2019-090407

(51) Int. Cl.
*G03G 9/087* (2006.01)
*G03G 9/08* (2006.01)

(52) U.S. Cl.
CPC ..... *G03G 9/0821* (2013.01); *G03G 9/08711* (2013.01); *G03G 9/08755* (2013.01)

(58) Field of Classification Search
CPC ..... G03G 9/0821; G03G 9/08711; G03G 9/08755; G03G 9/08793
See application file for complete search history.

(56) References Cited

U.S. PATENT DOCUMENTS

| | | | |
|---|---|---|---|
| 4,802,977 | A | 2/1989 | Kanda et al. |
| 4,844,349 | A | 7/1989 | Kanda et al. |
| 5,016,823 | A | 5/1991 | Kato et al. |
| 5,111,998 | A | 5/1992 | Kanda et al. |
| 5,270,143 | A | 12/1993 | Tomiyama et al. |
| 5,319,424 | A | 6/1994 | Tomiyama et al. |
| 5,338,638 | A | 8/1994 | Tsuchiya et al. |
| 5,364,720 | A | 11/1994 | Nakazawa et al. |
| 5,424,810 | A | 6/1995 | Tomiyama et al. |
| 5,447,815 | A | 9/1995 | Kato et al. |
| 5,489,498 | A | 2/1996 | Ohno et al. |
| 5,712,075 | A | 1/1998 | Mitsumura et al. |
| 5,753,396 | A | 5/1998 | Nakamura et al. |
| 5,854,365 | A | 12/1998 | Ohno et al. |
| 5,931,306 | A | 8/1999 | Mitsumura et al. |
| 6,207,339 | B1 | 3/2001 | Kato et al. |
| 8,288,069 | B2 | 10/2012 | Fujikawa et al. |
| 8,323,726 | B2 | 12/2012 | Naka et al. |
| 8,986,914 | B2 | 3/2015 | Fujikawa et al. |
| 9,034,549 | B2 | 5/2015 | Shiotari et al. |
| 9,158,216 | B2 | 10/2015 | Shimano et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,329,507 | B2 | 5/2016 | Watanabe |
| 9,377,705 | B2 | 6/2016 | Shimano et al. |
| 9,383,668 | B2 | 7/2016 | Noji et al. |
| 9,500,972 | B2 | 11/2016 | Tanaka et al. |
| 9,575,424 | B2 | 2/2017 | Nakagawa et al. |
| 9,594,323 | B2 | 3/2017 | Fujikawa et al. |
| 9,599,919 | B2 | 3/2017 | Isono et al. |
| 9,785,068 | B2 | 10/2017 | Umeda et al. |
| 9,829,816 | B2 | 11/2017 | Tanaka et al. |
| 9,835,964 | B2 | 12/2017 | Yoshida et al. |
| 2009/0130583 | A1* | 5/2009 | Katsuta ..... G03G 9/08782 430/108.5 |
| 2009/0233212 | A1 | 9/2009 | Fujikawa et al. |
| 2011/0207044 | A1* | 8/2011 | Zwartz ..... G03G 9/09775 430/105 |
| 2015/0248072 | A1 | 9/2015 | Katsuta et al. |
| 2019/0332027 | A1 | 10/2019 | Kenmoku et al. |

FOREIGN PATENT DOCUMENTS

| | | | |
|---|---|---|---|
| JP | S57-178429 | * 11/1988 | ..... G03G 9/08 |
| JP | 2014-164274 | 9/2014 | |
| JP | 2015-064449 | 4/2015 | |

OTHER PUBLICATIONS

Translation of S57-178429.*

* cited by examiner

*Primary Examiner* — Peter L Vajda
(74) *Attorney, Agent, or Firm* — Venable LLP

(57) ABSTRACT

A toner comprising a toner particle that includes a binder resin, wherein in dynamic viscoelasticity measurement of the toner, the storage elastic modulus of the toner at 70° C. is from 0.10 MPa to 3.00 MPa, and in nanoindentation measurement of the toner, the surface storage elastic modulus of the toner at 25° C. under 150 μN of load is from 2.80 GPa to 4.50 GPa.

12 Claims, No Drawings

TONER AND TONER MANUFACTURING METHOD

BACKGROUND OF THE INVENTION

Field of the Invention

The present invention relates to a toner for developing electrostatic images, and to a manufacturing method therefor.

Description of the Related Art

In recent years, methods such as electrophotographic methods for developing image data through electrostatic latent images have been used in various fields, and in addition to having higher image quality and higher speeds, copiers and printers are now required to be smaller, more energy efficient and longer lived.

There is particular demand for reductions in copier and printer running costs. To this end, there is demand for energy savings and longer-lived machines that allow long-term printing with a single cartridge. To save energy in particular, there is demand for toners having excellent low temperature fixability to enable power savings during heating and fixing.

In a long-lived development system, the heat within the developing apparatus or the mechanical stress from the members including the developing roller and developing blade impacts the toner over a long period of time. The toner deforms under this heat and stress and may be cracked or crushed as a result. When cracked or crushed toner attaches to other members, a suitable charge cannot be applied to the toner from members such as the developing blade, and the toner is transferred to non-image parts of the printed image, causing an image defect called fogging.

If the toner further attaches and accumulates on matter already adhering to other members, moreover, it may cause vertical streaks called development streaks in the direction of paper discharge on the half-tone part of the printed image. In such a long-lived development system, there is need for toner with excellent development durability that is not subject to such image defects of fogging and development streaks over a long period of time.

To achieve both low temperature fixability and development durability, the viscoelasticity and melt viscosity of the toner are of interest. The toner is subject to heat and mechanical stress within the developing apparatus, causing toner cracking and crushing. Increasing the viscoelasticity and melt viscosity of the toner is useful for improving development durability because it makes the toner resistant to deformation from external heat and stress.

In the fixing step, on the other hand, reducing the viscoelasticity and melt viscosity of the toner is useful for improving low temperature fixability because the toner can be fixed on the paper at a lower temperature. Low temperature fixability and development durability are thus conflicting properties, and much research has been done in the past into methods of satisfying both.

Japanese Patent Application Publication 2014-164274 proposes a toner a toner in which the surface hardness and displacement as measured by the nanoindentation method are within specific ranges.

Japanese Patent Application Publication 2015-64449 proposes a toner particle containing a specific amorphous polyester resin, a crystalline polyester and aluminum element, wherein the surface layer contains an amorphous polyester having ethylenically unsaturated double bonds.

SUMMARY OF THE INVENTION

Through these techniques, it has been possible to improve development durability while maintaining low temperature fixability. However, it has become difficult to satisfy more recent demands for further energy savings and longer operating lives. There is room for further improvement in order to achieve both energy savings and longer lives.

The present invention provides a toner that resolves the above problems of prior art. That is, the present invention provides a toner having satisfactory developing performance whereby the image defects of fogging and development streaks can be suppressed while maintaining low temperature fixability in a long-lived development system.

A toner comprising a toner particle that includes a binder resin, wherein in dynamic viscoelasticity measurement of the toner, the storage elastic modulus of the toner at 70° C. is from 0.10 MPa to 3.00 MPa, and in nanoindentation measurement of the toner, the surface storage elastic modulus of the toner at 25° C. under 150 μN of load is from 2.80 GPa to 4.50 GPa.

The present invention can provide a toner having satisfactory developing performance whereby the image defects of fogging and development streaks can be suppressed while maintaining low temperature fixability in a long-lived development system.

Further features of the present invention will become apparent from the following description of exemplary embodiments.

DESCRIPTION OF THE EMBODIMENTS

The expression "from XX to YY" or "XX to YY" representing the numerical range means a numerical range including a lower limit and an upper limit which are endpoints unless otherwise specified.

The present invention is explained in detail below.

Because the toner of the invention has a high storage elastic modulus of the toner surface, it is unlikely to deform even when subjected to long-term stress from the developing roller and developing blade during development. It is thus possible to satisfy demands for high toner developing performance while maintaining low temperature fixability in a long-lived development system.

The inventors believe that the precise reasons why these effects are obtained are as follows.

In the toner fixing step, heat and pressure are applied from members such as the fixing roller to fix the toner on the paper. Conventionally, it has been argued that there is a correlation between the fixing temperature and the value of the storage elastic modulus of the toner obtained by dynamic viscoelasticity measurement of the toner. The storage elastic modulus at 100° C. has been commonly used in the past, but recently fixing temperatures have tended to be lower due to demands for energy savings.

In this context, the inventors' studies have shown that the storage elastic modulus at 70° C. correlates more highly with the fixing temperature than the storage elastic modulus at 100° C. That is, in dynamic viscoelasticity measurement of the toner the storage elastic modulus of the toner at 70° C. must be in the range from 0.10 MPa to 3.00 MPa.

If the storage elastic modulus of the toner at 70° C. is not more than 3.00 MPa, the toner has excellent low temperature fixability. One the other hand, a storage elastic modulus at 70° C. of at least 0.10 MPa results in a toner with excellent development durability that resists heat deformation because it has a suitable storage elastic modulus.

The storage elastic modulus of the toner at 70° C. is more preferably in the range from 0.20 MPa to 2.50 MPa. Within this range, it is possible to satisfy demands for both development durability and low temperature fixability at a higher level. The storage elastic modulus at 70° C. can be controlled by controlling the type of binder resin or the types or ratios of monomers constituting the binder resin.

In nanoindentation measurement of the toner, moreover, the surface storage elastic modulus of the toner at 25° C. under 150 μN of load must be in the range from 2.80 GPa to 4.50 GPa. The surface storage elastic modulus here represents the storage elastic modulus of the part very near the surface of the toner, and the inventors' researches have shown that this correlates with development durability.

As discussed above, toner cracking and crushing occur when the toner is subject to repeated stress from members such as the developing roller and developing blade during development. If the surface storage elastic modulus is at least 2.80 GPa, the toner resists deformation even when subject to repeated stress in a long-lived development system, and the image defects of fogging and development streaks can be suppressed.

Inorganic or organic particles called external additives are also added externally to the toner particle surface as necessary for purposes of charge assistance and flowability improvement. This means that if the surface storage elastic modulus is not more than 4.50 GPa, the resulting toner has excellent development durability because the external additive can become fixed to a suitable degree on the toner particle surface and act effectively as an external additive over a long period of time.

The surface storage elastic modulus is more preferably in the range from 3.00 GPa to 4.50 GPa. Within this range, the toner has even better development durability. The surface storage elastic modulus under 150 μN of load can be controlled by means of the Tg and acid value of the resin on the toner particle surface and the amount of surface metal ions.

In nanoindentation measurement of the toner particle, moreover, the surface storage elastic modulus of the toner at 25° C. under 30 μN of load is preferably in the range from 3.50 GPa to 8.00 GPa, or more preferably in the range from 4.50 GPa to 6.50 GPa.

Nanoindentation measurement under 30 μN of load measures the viscoelasticity of a part closer to the toner particle surface than that measured under 150 μN of load. Consequently, nanoindentation measurement under 30 μN of load is used for toner particles that have not been covered with an external additive.

If the surface storage elastic modulus of the toner particle under 30 μN of load is within this range, only the outermost surface of the toner particle has a high storage elastic modulus, resulting in a toner that has excellent low temperature fixability with little fixing hindrance while also having high developing performance. The surface storage elastic modulus under 30 μN of load can be controlled by means of the Tg and acid value of the resin on the toner particle surface and the amount of surface metal ions.

In nanoindentation measurement of the toner particle, moreover, the surface loss modulus of the toner at 25° C. under 30 μN of load is preferably in the range from 0.25 GPa to 1.20 GPa, or more preferably in the range from 0.30 GPa to 1.00 GPa.

The surface loss modulus represents the viscosity term of the viscoelasticity of the toner particle surface. If the surface loss modulus of the toner particle is low, the toner resembles an elastic body, and is resistant to deformation from repeated stress applied from outside. If the surface loss modulus is high, on the other hand, the toner resembles a viscous body, and is unlikely to crack because it dissipates excessive momentary external force or in other words impact force.

That is, if the surface loss modulus is within the above range the toner is suitably elastic and viscous, is unlikely to be damaged by external force, and resists cracking because it dissipates excessive impact force. The toner has high development durability as a result. The surface loss modulus under 30 μN of load can be controlled by means of the Tg and acid value of the resin on the toner particle surface and the amount of surface metal ions.

Moreover, given P(M) as the total of the peak intensities of Mg, Al, Ca and Fe as obtained by time-of-flight secondary ion mass spectrometry (TOF-SIMS) of the toner particle and P(C) as the peak intensity of the C as obtained by TOF-SIMS of the toner particle, preferably the following formula (1) is satisfied:

$$2.0 \leq P(M)/P(C) \leq 30.0 \quad (1)$$

or more preferably:

$$2.5 \leq P(M)/P(C) \leq 25.0.$$

It is thought that in a toner particle that satisfies this formula, the outermost surface is ion crosslinked by a polyvalent metal (Mg, Al, Ca and/or Fe). If P(M)/P(C) is at least 2.0, this means that the toner particle surface is sufficiently crosslinked, deformation is unlikely in response to external stress, and crushing can be suppressed.

If P(M)/P(C) is not more than 30.0, on the other hand, this means that the toner has a suitable viscosity due to moderate crosslinking, and therefore resists cracking because impact force is dissipated.

P(M)/P(C) can be controlled by means of the added amount of the polyvalent metal ion.

Also preferably the toner particle contains a polar resin A on the surface thereof, the polar resin A has an acid value Av, and this acid value Av is in the range from 2 mg KOH/g to 30 mg KOH/g. The polar resin A is also preferably crosslinked by a polyvalent metal. The acid value is more preferably in the range from 5 mg KOH/g to 25 mg KOH/g.

It is thought that when the toner particle is manufactured by a method of granulation in an aqueous medium, the polar resin, which has affinity for water, positions itself at the interface with the water, with the polar groups oriented on the outermost surface. When a divalent or higher water-soluble metal salt is added with the polar groups in this orientation, the water-soluble metal salt dissolves in the aqueous medium, producing divalent or higher metal ions. It is thought that these divalent or higher metal ions coordinate with the polar groups, crosslinking the polar resin and forming a hard toner particle surface.

If the acid value of the polar resin A is at least 2 mg KOH/g, there is more crosslinking on the toner particle surface, so that deformation is less likely in response to external stress, and crushing can be suppressed. If the acid value is not more than 30 mg KOH/g, the resulting toner has a certain viscosity due to moderate crosslinking, and therefore resists cracking because impact force is dissipated.

The content (added amount) of the polar resin A is preferably 1 to 20 mass parts, or more preferably 2 to 10 mass parts per 100 mass parts of the binder resin or the polymerizable monomer that produces the binder resin.

The polyvalent metal is preferably at least one selected from the group consisting of Al, Ca, Mg and Fe. One of these metals alone or a combination of multiple kinds may be used. These metals are divalent or higher metals that crosslink strongly with the polar resin A on the toner particle surface. This produces a toner that resists cracking and crushing. A metal selected from the group consisting of the trivalent metals Al and Fe is preferred, and Al is more preferred.

With a trivalent metal salt, the toner is more resistant to cracking and crushing because there are more crosslinking points with the polar resin A. Moreover, Al has a smaller ion radius than Fe and attracts the polar groups of the resin more strongly, resulting in stronger crosslinking and a toner that is more resistant to cracking and crushing.

The polar resin A preferably contains a polyester resin, and more preferably is a polyester resin. Because a polyester resin has strong adhesiveness with paper, it adheres to the paper when the toner melts and is unlikely to detach. It therefore has good low temperature fixability in comparison with other resins.

The method for manufacturing the toner particle is not particularly limited, but preferably includes an addition step in which a water-soluble metal salt is added to an aqueous medium containing a toner particle having a binder resin, and a step of maintaining the pH of the aqueous medium under conditions of pH 7.5 to 10.0.

Preferably the toner manufacturing method has a granulation step in which particles of a polymerizable monomer composition containing the polar resin A and a polymerizable monomer for producing the binder resin are formed in an aqueous medium, followed by a polymerization step in which the polymerizable monomer contained in the particles of the polymerizable monomer composition is polymerized to produce resin particles, wherein the polymerization step includes an addition step in which a water-soluble metal salt is added to the aqueous medium, and a step of maintaining the aqueous medium containing the resulting resin particles at a pH in the range from 7.5 to 10.0, the polar resin A has an acid group, and the acid dissociation constant pKa of the polar resin A is not more than 7.5, and the water-soluble metal salt is a salt of a divalent or higher metal.

As discussed above, it is thought that when the toner particle is manufactured by a method of granulation in an aqueous medium, the polar resin, which has high affinity for water, positions itself at the interface with the water, with the polar groups oriented on the outermost surface. When a divalent or higher water-soluble metal salt is added with the polar groups in this orientation, the polar resin becomes crosslinked, forming a hard toner particle surface.

It is known that when crosslinking by divalent or higher metal ions occurs in a low-pH state, the divalent or higher metal ions attach to the polar groups on the outermost layer without the polar groups being sufficiently dissociated. This is one reason for low toner durability.

This is why the polymerization step for producing the resin particles includes a step of adding a salt of a divalent or higher metal and then maintaining the aqueous medium containing the resulting resin particles a pH in the range from 7.5 to 10.0 (holding step). These steps cause the polar groups on the resin particle surface to be dissociated and the divalent or higher metal ions to coordinate with the ionized polar groups. The toner particle surface is thoroughly crosslinked as a result, and it is possible to manufacture a toner with excellent development durability. The pH in the holding step is preferably in the range from 8.0 to 9.0.

The temperature in the holding step is preferably in the range from 70° C. to 95° C., or more preferably in the range from 75° C. to 90° C. The time is preferably in the range from about 5 minutes to 120 minutes, or more preferably in the range from about 10 minutes to 90 minutes.

Preferably the polar resin A has an acid group, and the acid dissociation constant pKa of the polar resin is not more than 7.5. If the pKa is not more than 7.5, strong crosslinking is achieved with the divalent or higher metal ions. The pKa is more preferably in the range from 5.0 to 7.0.

Within this range, the step of maintaining a pH in the range from 7.5 to 10.0 can easily cause dissociation of the polar groups on the resin particle surface and coordination between the divalent or higher metal ions and the ionized polar groups. It is thus possible to manufacture a toner with excellent development durability in which the toner particle surface is strongly crosslinked.

The water-soluble metal salt is preferably a salt of a divalent or higher metal. A salt of a divalent or higher metal crosslinks more strongly with the polar resin A, resulting in a hard toner particle surface. It is thus possible to manufacture a toner that is more durable and resistant to image defects during development.

The water-soluble metal salt is more preferably a trivalent metal salt. If the water-soluble metal salt is trivalent, it crosslinks more easily with the polar resin, resulting in a toner that is more durable and resistant to image defects during development.

A salt of at least one metal selected from the group consisting of Al, Ca, Mg and Fe is preferred. A salt of at least one selected from the group consisting of Al and Fe is more preferred, and a salt of Al is still more preferred.

The type of salt is not particularly limited, but preferably a chloride salt, hydroxide salt, phosphate salt or the like may be used, and a chloride salt is more preferred.

In the addition step, the polymer conversion rate of the polymerizable monomer is preferably in the range from 50% to 100%. As polymerization of the polymerizable monomer progresses, polymer shrinkage occurs. If the polymer conversion rate is at least 50%, it is easier for the hard surface layer to conform to the shrinkage caused by polymerization as the surface is crosslinked by the metal ions, resulting in good adhesiveness between the surface layer and the polymer. It is thus possible to manufacture a toner with strong development durability in which the polar resin and metal ions are thoroughly crosslinked.

More preferably, the addition step is performed with a polymer conversion rate of in the range from 75% to 100% of the polymerizable monomer. Adhesiveness between the surface layer and the polymer is further improved as a result, and it is possible to manufacture a highly durable toner in which the polar resin and metal ions are more thoroughly crosslinked.

The addition step is preferably performed before a step of maintaining the pH of the aqueous medium under conditions of pH in the range from 7.5 to 10.0 (holding step). Performing a holding step after the addition step serves to thoroughly dissociate the acid groups of the polar resin A. It is thus possible to further promote crosslinking between the metal ions and acid groups, and to manufacture a toner with strong development durability.

The pH of the aqueous medium when the water-soluble metal salt is added (pH of aqueous medium immediately before addition step) is not particularly limited, but is preferably in the range from about 4.0 to 9.0, or more preferably in the range from about 4.5 to 8.7.

Also, the polymerizable monomer is preferably at least one selected from the group consisting of the styrene monomers and (meth)acrylic acid ester monomers. Using such a monomer gives the toner particle a uniform composition. As a result, cracks are less likely to start from inside the toner particles in response to external stress, and development durability is excellent.

More preferably, the polymerizable monomer is styrene and at least one selected from the group consisting of the (meth)acrylic acid ester monomers. The styrene monomer and (meth)acrylic acid ester monomer are discussed below.

The concentration of the water-soluble metal salt in the aqueous medium in the addition step is preferably in the range from 0.2 mmol/L to 40.0 mmol/L, or more preferably in the range from 0.5 mmol/L to 20.0 mmol/L.

If the water-soluble metal salt has a concentration of at least 0.2 mmol/L, it can crosslink adequately with the polar resin, making it possible to manufacture a toner that is highly durable and resistant to image defects during development. A concentration of not more than 40.0 mmol/L produces a suitable degree of cross linking between the polar resin and the metal ions, making it possible to manufacture a toner that resists cracking.

Next, the toner particle manufacturing method is explained in detail using examples of procedures and usable materials, but these examples are not limiting.

The toner particle manufacturing method is not particularly limited. A manufacturing method using suspension polymerization is explained below.

Toner Particle Manufacturing Method

A manufacturing method using suspension polymerization preferably includes the following manufacturing steps but is not limited to the following methods.

A preparation step of preparing a liquid dispersion containing a poorly water soluble inorganic fine particle A granulation step of adding to the liquid dispersion a polymerizable monomer composition containing a polymerizable monomer for producing the binder resin, a polar resin A, and a colorant, release agent and other additives as necessary, and forming particles of the polymerizable monomer composition in the liquid dispersion A polymerization step (suspension polymerization step) of polymerizing the polymerizable monomer contained in the polymerizable monomer composition to produce a toner particle An addition step of adding a water-soluble metal salt to the aqueous medium either during or after the polymerization step A holding step (alkali treatment step) of maintaining the pH of the aqueous medium in the range from 7.5 to 10.0 after the addition step The following composition preparation step may also be included before the granulation step for example.

A composition preparation step of mixing a polymerizable monomer for producing the binder resin, a polar resin A, and a colorant, release agent and other additives as necessary to prepare a polymerizable monomer composition.

The toner particle obtained from the polymerization step (polymerization reaction solution containing the toner particle) may also be subjected to the following distillation step and washing, filtration and drying step. The toner particle obtained by these steps may also be subjected to the following external addition step.

Distillation step of distilling the resulting polymerization reaction solution containing the toner particle Washing, filtration and drying step of washing, filtering and drying the resulting toner particle (or liquid dispersion containing the toner particle)

External addition step of adding external additive (such as inorganic fine powder) to resulting toner particle That is, the toner particle manufacturing method preferably includes a liquid dispersion preparation step, a composition preparation step, a granulation step, a polymerization step (including temperature increase step during polymerization), an addition step, a distillation step, a holding step, a washing, filtration and drying step and an external addition step, preferably in that order.

Each step is explained in detail next.

Liquid Dispersion Preparation Step

A liquid dispersion containing a poorly water-soluble inorganic fine particle as a dispersant is prepared first.

Liquid Dispersion

The liquid dispersion containing the poorly water-soluble inorganic fine particle may be a liquid dispersion (aqueous dispersion) containing a poorly water-soluble inorganic fine particle and water. This liquid dispersion may also contain a counter ion produced in the course of producing the poorly water-soluble inorganic fine particle, or an acid (such as hydrochloric acid or sulfuric acid) or alkali (such as sodium hydroxide or sodium carbonate) added to adjust the pH or the like. However, the liquid dispersion may also consist only of the poorly water-soluble inorganic fine particle and water.

Water

Ion-exchange water for example may be used as the water (dispersion medium) in the liquid dispersion. The liquid dispersion is preferably prepared using at least 100 mass parts of water per 100 mass parts of the polymerizable monomer. If the amount of water used is at least 100 mass parts, oil droplets (polymerizable monomer composition particles) can be easily formed without causing oil-water reversal.

Poorly Water-Soluble Inorganic Fine Particle

The poorly water-soluble inorganic fine particle serves as a dispersion stabilizer for the polymerizable monomer composition in the liquid dispersion in the granulation step. A poorly water-soluble fine particle here is one having an average volume particle diameter of not more than 1.0 μm and a solubility (at a measurement temperature of 60° C.) of not more than 10 (representing the mass (g) at which the solute can dissolve in 100 g of water at a specific pH, such as one in the range from 4.0 to 10.0).

Both inorganic and organic dispersion stabilizers are known as dispersion stabilizers for suspension polymerization, but an inorganic dispersion stabilizer is preferred. An organic dispersion stabilizer (such as a surfactant) may also be used in combination with a poorly water-soluble inorganic fine particle.

Examples of poorly water-soluble inorganic fine particles include inorganic dispersion stabilizers (poorly water-soluble inorganic dispersion stabilizers) such as calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, alumina and the like.

Of these, calcium phosphate is preferred as a poorly water-soluble inorganic fine particle to facilitate particle size control. One kind of poorly water-soluble inorganic fine particle or a combination of multiple kinds may be used.

Method for Preparing Liquid Dispersion

When preparing a liquid dispersion of the dispersed poorly water-soluble inorganic fine particle, a commercial dispersion stabilizer may be used as is or dispersed in water as the poorly water-soluble inorganic fine particle. To obtain a poorly water-soluble inorganic fine particle (dispersion stabilizer fine particle) with a fine uniform particle diameter, however, the poorly water-soluble inorganic fine particle is preferably produced and prepared under high-speed stirring in water.

When calcium phosphate is used as the poorly water-soluble inorganic fine particle for example, it can be prepared as follows. That is, the poorly water-soluble inorganic fine particle can be obtained by mixing a sodium phosphate aqueous solution and a calcium chloride aqueous solution under high-speed stirring at a low-temperature range of not more than 60° C. to form fine particles of calcium phosphate in water.

Granulation Step

A polymerizable monomer composition containing a polymerizable monomer, the polar resin A, and a colorant, release agent and other additives as necessary is dispersed in the liquid dispersion containing the poorly water-soluble inorganic fine particle, and particles of the polymerizable monomer composition are granulated. That is, a dispersion (liquid dispersion) containing a polymerizable monomer composition particle together with the poorly water-soluble inorganic fine particle as a dispersion stabilizer can be obtained by the granulation step.

All of the polymerizable monomer composition added to the liquid dispersion need not constitute polymerizable monomer composition particles, and a part of the added polymerizable monomer composition (such as a polymerization initiator) may also be contained in the dispersion medium.

Consequently, the relative used amounts of the poorly water-soluble inorganic fine particle and each component of the polymerizable monomer composition relative to the polymerizable monomer and polymerizable monomer composition are based on the input amounts of the polymerizable monomer and polymerizable monomer composition.

As discussed above, moreover, the polymerizable monomer, polar resin A, and colorant, release agent and other additives as necessary may also be mixed in advance to prepare a polymerizable monomer composition (composition preparation step), and the prepared polymerizable monomer composition can then be dispersed in the liquid dispersion to prepare particles of the polymerizable monomer composition.

A stirring apparatus such as a TK mixer (product name, Tokushu Kika Kogyo Co., Ltd.) or the like may be used for granulating the particles of the polymerizable monomer composition.

Polymerizable Monomer Composition

In addition to the polymerizable monomer, the polymerizable monomer composition may contain the polar resin A and additives such as a polymerization initiator, a charge control agent, a chain transfer agent, a polymerization inhibitor, a crosslinking agent and the like. The polymerizable monomer composition can be obtained by mixing the polymerizable monomer and additives.

Polymerizable Monomer

The polymerizable monomer may be chosen appropriately according to the toner particle being prepared, but for example a radical polymerizable vinyl polymerizable monomer may be used.

A monofunctional polymerizable monomer or polyfunctional polymerizable monomer may be used as the vinyl polymerizable monomer.

Examples of monofunctional polymerizable monomers include the following: styrene monomers such as for example styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene;

(meth)acrylic acid ester monomers including for example acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; and methylene aliphatic monocarboxylate esters; vinyl esters such as vinyl acetate, vinyl propionate, vinyl butyrate, vinyl benzoate and vinyl formate; vinyl ethers such as vinyl methyl ether, vinyl ethyl ether and vinyl isobutyl ether; and vinyl ketones such as vinyl methyl ketone, vinyl hexyl ketone and vinyl isopropyl ketone.

Examples of polyfunctional polymerizable monomer include the following: diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy-diethoxy)phenyl) propane, trimethylol propane triacrylate, tetramethylol methane tetracrylate, ethylene glycol dimethacrylate, diethylene glycol dimethacryalte, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-methacryloxy-diethoxy)phenyl) propane, 2,2'-bis (4-(methacryloxy-polyethoxy)phenyl) propane, trimethylol propane trimethacrylate, tetramethylol methane tetramethacrylate, divinyl benzene, divinyl naphthalene, divinyl ether and the like.

One kind of polymerizable monomer alone or a combination of multiple kinds may be used.

From a fixing standpoint, the polymerizable monomer is preferably used in the amount of at least 50 mass % of the total polymerizable monomer composition.

Polar Resin

A polyester resin, polycarbonate resin, phenol resin, epoxy resin, polyamide resin, cellulose resin, styrene acrylic resin or the like may be used as the polar resin. One kind of polar resin alone or a mixture of multiple kinds may be used.

The polar resin preferably includes a polyester resin. The polyester resin is preferably amorphous. An amorphous resin can confer heat-resistant storability. The presence or absence of a melting point according to DSC measurement can be used to specify whether or not the resin is amorphous.

The polyester resin is preferably a polycondensate of a polyhydric alcohol and a polycarboxylic acid.

Examples of polyhydric alcohol components include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, bisphenol A ethylene oxide adduct and bisphenol A propylene oxide adduct.

Example of polycarboxylic acids include benzenedicarboxylic acids and their anhydrides, such as phthalic acid, terephthalic acid, isophthalic acid and phthalic anhydride; and alkyldicarboxylic acids and their anhydrides, such as succinic acid, adipic acid, sebacic acid and azelaic acid.

Polymerization Initiator

Either an oil-soluble initiator or water-soluble initiator or both may be used as a polymerization initiator when polymerizing the polymerizable monomer.

Examples of oil-soluble initiators include nitrile initiators such as 2,2'-azobisisobutyronitrile, 2,2'-azobis-2,4-dimethylvaleronitrile, 1,1'-azobis(cyclohexane-1-carbonitrile) and 2,2'-azobis-4-methoxy-2,4-dimethylvaleronitrile; and peroxide initiators such as acetylcyclohexyl sulfonyl peroxide, diisopropyl peroxycarbonate, decanonyl peroxide, lauroyl peroxide, stearoyl peroxide, propionyl peroxide, acetyl peroxide, t-butyl peroxy-2-ethylhexanoate, benzoyl peroxide, t-butyl peroxypivalate, t-butyl peroxyisobutyrate, cyclohexanone peroxide, methyl ethyl ketone peroxide, dicumyl peroxide, t-butyl hydroperoxide, di-t-butyl peroxide and cumene hydroperoxide.

Examples of water-soluble initiators include ammonium persulfate, potassium persulfate, 2,2'-azobis(N,N'-dimethylene isobutyroamidine) hydrochloride, 2,2'-azobis(2-aminodinopropane) hydrochloride, azobis(isobytyramidine) hydrochloride, 2,2'-azobisisobutyronitrile sodium sulfonate, ferrous sulfate and hydrogen peroxide.

From the standpoint of polymerization efficiency and safety, these polymerization initiators are preferably used in the amount of in the range from 0.1 to 20 mass parts, or more preferably in the range from 0.1 to 15 mass parts per 100 mass parts of the polymerizable monomer. One kind of polymerization initiator alone or a mixture of two or more kinds may be used after consulting the 10-hour half-life.

Crosslinking Agent

A crosslinking agent may be used when polymerizing the polymerizable monomer in order to increase the stress resistance of the toner particle and control the molecular weights of the constituent molecules of the toner particle.

A compound having two or more polymerizable double bonds may be used as the crosslinking agent. Specific examples include aromatic divinyl compounds such as divinyl benzene and divinyl naphthalene; carboxyl acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having three or more vinyl groups. One of these crosslinking agents alone or a mixture of two or more kinds may be used.

Considering the fixing performance and offset resistance of the toner, these crosslinking agents are preferably used in the amount of from 0.05 to 10 mass parts, or more preferably from 0.10 to 5 mass parts per 100 mass parts of the polymerizable monomer.

Colorant

The colorant may be selected appropriately from known colorants in the toner field after considering hue angle, chroma, lightness, weather resistance, OHT transparency and dispersibility in the toner and the like. Specific examples include the black, yellow, magenta and cyan pigments described below, as well as other colorants such as dyes as necessary.

One kind of colorant alone or a mixture of multiple kinds may be used. The colorant may also be used in the form of a solid solution.

The content (added amount) of the colorant is preferably 1 to 20 mass parts per 100 mass parts of the binder resin or polymerizable monomer for producing the binder resin. Tinting strength is easily obtained if at least one part of the colorant is added, while if not more than 20 mass parts are added, a sharper particle size distribution can be obtained. To disperse the pigment or other colorant in the toner particle, the colorant may first be dispersed in a solvent, and a polymerizable monomer (such as styrene) may be used as this solvent.

Black Colorant

A known black colorant in the toner field may be used as a black colorant. Specific examples of black colorants include carbon black and blacks obtained by blending the yellow, magenta and cyan colorants described below.

The carbon black is not particularly limited, and for example a carbon black obtained by a manufacturing method such as a thermal method, acetylene method, channel method, furnace method or lamp black method may be used. One kind of carbon black alone or a mixture of two or more kinds may be used. The carbon black may be a coarse pigment, or a prepared pigment composition as long as this does not significantly inhibit the effects of the pigment dispersant.

The average particle diameter of the primary particles of the carbon black is preferably in the range from 14 nm to 80 nm, or more preferably in the range from 25 nm to 50 nm. If the average particle diameter is at least 14 nm, the toner does not exhibit a reddish tone and the black is desirable for forming full-color images. If the carbon black has an average particle diameter of not more than 80 nm, it is easily dispersible, and can easily impart a suitable tinting strength because the tinting strength is not excessively low.

An enlarged photograph taken with a scanning electron microscope is used to measure the average particle diameter of the carbon black. The longest axis (long axis) and shortest axis (short axis) of black particles observed as primary particles in the enlarged photograph are measured, and the average value of the long axis and short axis is calculated and given as the particle diameter of each measured particle. The diameters of 100 carbon black particles are measured, and the average of these is given as the average particle diameter. The magnification of the scanning electron microscope may be any magnification at which the primary particles of the carbon black can be distinguished.

Yellow Colorant

A known yellow colorant in the toner field may be used as the yellow colorant.

Typical examples of pigment-based yellow colorants include condensed polycyclic pigments, isoindolinone compounds, anthraquinone compounds, azo metal complex methine compounds and allylamide compounds. Specific examples include C.I. pigment yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199.

Examples of dye-based yellow colorants include C.I. solvent yellow 33, 56, 79, 82, 93, 112, 162 and 163 and C.I. disperse yellow 42, 64, 201 and 211.

Magenta Colorant

A known magenta colorant in the toner field may be used as the magenta colorant.

A condensed polycyclic pigment, diketopyrrolopyrrole compound, anthraquinone compound, quinacridone compound, basic dye lake compound, naphthol compound, benzimidazolone compound, thioindigo compound or perylene compound for example may be used as the magenta colorant. Specific examples include C.I. pigment red 2, 3, 5, 6, 7, 23, 48:2, 48:3, 48:4, 57:1, 81:1, 122, 146, 150, 166, 169, 177, 184, 185, 202, 206, 220, 221, 238, 254 and 269 and C.I. pigment violet 19.

Cyan Colorant

A known cyan colorant in the toner field may be used as the cyan colorant. A phthalocyanine compound or derivative, an anthraquinone compound or a basic dye lake compound may be used as the cyan colorant. Specific examples include C.I. pigment blue 1, 7, 15, 15:1, 15:2, 15:3, 15:4, 60, 62 and 66.

Release Agent

The toner particle may also contain a release agent. Examples of release agents include the following: aliphatic hydrocarbon waxes such as low-molecular-weight polyethylene, low-molecular-weight polypropylene, microcrystalline wax, Fischer-Tropsch wax and paraffin wax; oxides of aliphatic hydrocarbon waxes, such as polyethylene oxide wax, and block copolymers of these; waxes consisting primarily of fatty acid esters, such as carnauba wax and montanic acid ester wax, and those such as deoxidized carnauba wax in which the fatty acid ester has been partly or entirely deoxidized; saturated linear fatty acids such as palmitic acid, stearic acid and montanic acid; unsaturated fatty acids such as brassic acid, eleostearic acid and parinaric acid; saturated alcohols such as stearyl alcohol, aralkyl alcohol, behenyl alcohol, carnaubyl alcohol, seryl alcohol and merisyl alcohol; polyhydric alcohols such as sorbitol; fatty acid amides such as linoleamide, oleamide and lauramide; saturated fatty acid bisamides such as methylene bis stearamide, ethyelene bis caproamide, ethylene bis lauramide and hexamethylene bis stearamide; unsaturated fatty acid amides such as ethylene bis oleamide, hexamethylene bis oleamide, N,N'-dioleyl adipamide and N,N'-dioleyl sebacamide; aromatic bisamides such as m-xylene bis stearamide and N,N'-distearyl isophthalamide; fatty acid metal salts (commonly called metal soaps) such as calcium stearate, calcium laurate, zinc stearate and magnesium stearate; waxes obtained by grafting aliphatic hydrocarbon waxes with vinyl monomers such as styrene and acrylic acid; partial ester compounds of fatty acids and polyols, such as behenic acid monoglyceride; and hydroxyl-containing methyl ester compounds obtained by hydrogenation of vegetable oils and fats.

From the standpoint of release performance and granulation stability, the total content (added amount) of the release agent is preferably in the range from 2.5 to 25.0 mass parts per 100 mass parts of the binder resin or the polymerizable monomer for producing the binder resin. If the amount of the release agent is at least 2.5 mass parts, release is easier during fixer, while if it is not more than 25.0 mass parts a uniform surface layer can be easily formed without disturbing the particle size distribution.

Charge Control Agent

A charge control agent may also be used to stably maintain the charging performance of the toner particle irrespective of the environment.

A known charge control agent may be used, and a charge control agent that can provide a rapid charging speed and stably maintain a constant charge quantity is preferred. When the toner particle is manufactured by a direct polymerization method, a charge control agent with low polymerization inhibition and effectively no soluble matter in aqueous dispersion media is preferred.

Specific examples of negative charge control agents include metal compounds of aromatic carboxylic acids such as salicylic acid, alkylsalicylic acid, dialkylsalicylic acid, naphthoic acid and dicarboxylic acid, metal salts or metal complexes of azo dyes or azo pigments, and boron compounds, silicon compound and calixarenes.

Examples of positive charge control agents include quaternary ammonium salts, polymeric compounds having such quaternary ammonium salts in the side chains, and guanidine compounds, nigrosine compounds and imidazole compounds.

One kind of charge control agent or a combination of two or more kinds may be used.

A metal-containing salicylic acid compound is preferred as a charge control agent other than a resin charge control agent, and one in which the metal is aluminum or zirconium is particularly desirable. An aluminum salicylate compound is especially desirable as a charge control agent.

Examples of resin charge control agents include polymers or copolymer having sulfonic acid groups, sulfonic acid salt groups, sulfonic acid ester groups, salicylic acid sites or benzoic acid sites.

The content (compounded amount) of the charge control agent is preferably in the range from 0.01 to 20.00 mass parts, or more preferably in the range from 0.05 to 10.00 mass parts per 100.00 mass parts of the binder resin or polymerizable monomer for producing the binder resin.

Chain Transfer Agent, Polymerization Inhibitor

A chain transfer agent and a polymerization inhibitor may also be added to control the degree of polymerization of the polymerizable monomer.

α-methylsytrene dimer, t-dodecylmercaptane, n-dodecylmercaptane, n-octylmercaptane, carbon tetrachloride or carbon tetrabromide for example may be used as the chain transfer agent.

A quinone compound such as p-benzoquinone, chloraniline, anthraquinone, phenanthraquinone or dichlorobenzoquinone, an organic hydroxy compound such as phenol, tertiary butyl catechol, hydroqjuinone, catechol or hydroxymonomethyl ether, a nitro compound such dinitrobenzene, dinitrotoluene or dinitrophenol, a nitroso compound such as nitrosobenzene or nitrosonaphthol, an amino compound such as methyl aniline, p-phenylene diamine, N,N'-tetraethyl-p-phenylene diamine or diphenylamine, or an organic sulfur compound such as tetraalkyluram disulfide or dithiobenzoyl disulfide or the like for example may be used as the polymerization inhibitor.

Polymerization Step

The polymerizable monomer in the polymerizable monomer composition particle is polymerized (suspension polymerized) in a liquid dispersion containing a poorly water-soluble inorganic particle and the polymerizable monomer composition particle to thereby produce a toner particle. A water-soluble metal salt is preferably added in the second half of this polymerization step to suppress cracking. This may be added either during the distillation step or after completion of the distillation step.

Distillation Step

To remove volatile impurities such as unreacted polymerizable monomer and by-products, the polymerization reaction solution containing the particle obtained by the polymerization step may be distilled after completion of polymerization to distill off part of the liquid dispersion. The distillation step may be performed at normal pressure (101325 Pa) or under reduced pressure (in the range from 0.5 kPa to 0.95 MPa).

Holding Step (Alkali Treatment Step)

A holding step of maintaining the pH in the range from 7.5 to 10.0 is preferably performed in order to crosslink the toner particle surface after addition of the water-soluble metal salt. This alkali treatment step may be performed during the second half of polymerization, or during or after distillation.

Washing, Filtration and Drying Step

The liquid dispersion containing the polymer particles such as toner particles obtained from the distillation step or the like may also be treated with an acid or alkali in order to remove dispersion stabilizer adhering to the polymer particle surface. In this case the polymer particles such as toner particles are separated from the liquid phase by a common solid-liquid separation method, but to completely remove the acid or alkali and the dispersion stabilizer component dissolved therein, water is added again to wash the polymer particles. After this washing step has been repeated several times to perform thorough washing, the toner particle is obtained by further solid-liquid separation. The resulting toner particle can then be dried by a known drying method as necessary.

External Addition Step

The toner particle may be used as is as a toner. Preferably an external additive is attached to the toner particle surface to impart various properties to the toner. The toner preferably contains the toner particle and an external additive.

Considering durability when the external additive is added to the toner particle, the particle diameter of the external additive is preferably not more than 1/10 the average particle diameter of the toner particle before addition of the external additive.

Examples of external additives include metal oxides such as aluminum oxide, titanium oxide, strontium titanate, cerium oxide, magnesium oxide, chromium oxide, tin oxide and zinc oxide; nitrides such as silicon nitride; carbides such as silicon carbide; inorganic metal salts such as calcium sulfate, barium sulfate and calcium carbonate; fatty acid metal salts such as zinc stearate and calcium stearate; and carbon black and silica. Of these, silica is preferred.

The content of the external additive is preferably in the range from 0.01 mass parts to 10 mass parts, or more preferably in the range from 0.05 to 5 mass parts per 100 mass parts of the toner particle. One kind of external additive alone or a combination of multiple kinds maybe be used. From the standpoint of charging stability, the surfaces of these external additives are preferably hydrophobically treated.

Examples of hydrophobic treatment agents include silane coupling agents such as methyl trimethoxy silane, methyl triethoxysilane, isobutyl trimethoxysilane, dimethyl dimethoxysilane, dimethyl diethoxysilane, trimethyl methoxysilane and hexamethylene disilazane and the like.

Toner Particle

The toner particle (toner) may be applied to image-forming methods using known one-component developing systems and two-component developing systems.

The toner particle (toner) maybe used in any system. For example, it can be applied to image-forming methods that use known one-component developing systems and two-component developing systems such as toners for high-speed systems, toners for oilless fixing, toners for cleanerless systems, and toners for developing systems in which carrier that has deteriorated over a long period of time in the developing device is collected sequentially, and fresh carrier is supplied.

The measurement methods used in the present invention are explained below.

Measuring Dynamic Viscoelasticity of Toner

An Ares rotating plate rheometer (manufactured by TA Instruments) is used as the measuring device.

For the measurement sample, 0.1 g of toner is pressure molded in a 25° C. environment with a tablet press into a disk 7.9 mm in diameter and 2.0±0.3 mm thick. Pressure molding was performed under conditions of 15 MPa, 60 seconds.

The sample is mounted on a parallel plate, the temperature is raised from room temperature (25° C.) to 120° C. in 15 minutes to adjust the shape of the sample and then cooled to the measurement initiation temperature for viscoelasticity measurement, and measurement is initiated. The sample is set so that the initial normal force is 0. Moreover, as discussed below, the effect of normal force is cancelled out in subsequent measurement by turning Auto Tension Adjustment to ON.

Measurement is performed under the following conditions.

(1) Parallel plate 7.9 mm in diameter is used.

(2) Frequency is set to 1.0 Hz.

(3) Initial value of applied strain (Strain) is set to 0.1%.

(4) Measurement is performed at a ramp rate of 2.0° C./min between 30° C. and 200° C. Measurement is performed under the following automatic adjustment mode setting conditions. Measurement is performed in automatic strain adjustment mode (Auto Strain).

(5) Max Applied Strain is set to 20.0%

(6) Max Allowed Torque is set to 200.0 g·cm and Min Allowed Torque to 0.2 g·cm.

(7) Strain Adjustment is set to 20.0% of current strain. Measurement is performed in automatic tension adjustment mode (Auto Tension).

(8) Auto Tension Direction is set to Compression (9) Initial Static Force is set to 10.0 g, and Auto Tension Sensitivity to 40.0 g.

(10) The Auto Tension operation condition is a Sample Modulus of at least $1.0\times10^3$ (Pa).

The storage elastic modulus at 70° C. is determined by the above measurement.

Surface Viscoelasticity Measurement of Toner (Toner Particle)

Measurement of the surface storage elastic modulus of the toner or toner particle by the nanoindentation method is performed using a TI-950 System Triboindenter (manufactured by Hysitron).

For the measurement sample, the toner or toner particle (hereunder simply called the toner) is attached to the tip of a Johnson's swab in a 25° C. environment, and 0.1 mg of the toner is spread on a 1 cm×1 cm silicon wafer.

The sample is mounted on a sample stand, and measurement is initiated under nanoindentation conditions at room temperature (25° C.) using a Birkovich diamond indenter (TI-0039, angle 142.3°, manufactured by Hysitron).

It is important here that focus settings be performed for the measurement sample before the start of measurement, so that measurement is performed under uniform focus conditions.

The measurement sample is focused on the software using a microscope. At this time the objective lens is focused sequentially at 5×, 20× and 50× magnifications. Subsequently, the objective lens is adjusted at 50×.

Next, a dedicated Al plate is used to calibrate the measurement space and load force. The position of the indenter tip and the focal position of the microscope camera are also configured, and the Z axis of the indenter is aligned.

The indenter tip is then moved above the silicon wafer with the adhering toner, and the microscope is focused on the toner to be measured.

Following these calibrations, measurement is performed under the following conditions.

With an indenter load condition of 30 μN, load is applied at a rate of 0.5 μN/s between 0 μN and 30 μN. Vibration is then applied with a frequency and time of 3.0 Hz for 3 seconds, 30 Hz for 5 seconds, 150 Hz for 15 seconds and 301.5 Hz for 40 seconds in that order, and nano-viscoelasticity is measured. As the frequency is changed, a 1-second stable time is provided between each frequency. The number of data plots is set to 200 points at 100 pts/sec, and the average value is calculated.

Measurement is initiated, and the horizontal axis is calculated as frequency (Hz) and the vertical axis as storage elastic modulus (GPa) and loss modulus (GPa).

30 toner particles are measured in this way, and the average value is used.

The indenter is always cleaned (both X and Y axis rods) each time a particle is measured.

When the load condition is 150 μN, measurement is performed as when the load condition is 30 μN except when load is being applied at a rate of 0.5 μN/s between 0 μN and 150 μN.

Isolating Toner Particle from Toner

When using the toner particle as a sample, a toner particle obtained by removing the external additive from the toner by the following methods is used.

Specific methods for removing the external additive from the toner include the following methods for example.

(1) 5 g of toner to which an external additive has been added is placed in a sample bottle, and 200 ml of methanol is added. A few drops of a surfactant are also added as necessary. "Contaminon N" (10 mass % aqueous solution of a pH 7 neutral detergent for cleaning precision measuring instruments, comprising a nonionic surfactant, an anionic surfactant and an organic builder, manufactured by Wako Pure Chemical Industries, Ltd.) may be used as the surfactant.

(2) The sample is dispersed for 5 minutes with an ultrasound cleaner to separate the external additive.

(3) The external additive is separated from the toner particle by suction filtration using a 10 μm membrane filter.

(4) Steps (2) and (3) above are performed three times.

A toner particle from which an external additive has been removed can be obtained by these operations.

Measuring Surface Metal Content of Toner Particle

The metal element on the toner particle surface is measured using a TOF-SIMS (TRIFT-IV, manufactured by ULVAC-PHI, Inc.). The analysis conditions are as follows.

Sample preparation: Toner particle is attached to indium sheet

Sample pre-treatment: None

Primary ion: $Au^+$

Acceleration voltage: 30 kV

Charge neutralization mode: ON

Measurement mode: Positive

Raster: 100 μm

Calculating Mg peak intensity P(Mg): The total peak count number of mass numbers from 23.70 to 24.20 according to the ULVAC-PHI, Inc. standard software (Win Cadense) is given as the peak intensity P(Mg).

Calculating Al peak intensity P(Al): The total peak count number of mass numbers from 26.50 to 27.00 according to the ULVAC-PHI, Inc. standard software (Win Cadense) is given as the peak intensity P(Al).

Calculating Ca peak intensity P(Ca): The total peak count number of mass numbers from 39.50 to 40.00 according to the ULVAC-PHI, Inc. standard software (Win Cadense) is given as the peak intensity P(Ca).

Calculating Fe peak intensity P(Fe): The total peak count number of mass numbers from 55.75 to 55.95 according to the ULVAC-PHI, Inc. standard software (Win Cadense) is given as the peak intensity P(Fe).

Total P(M) of peak intensities of Mg, Al, Ca and Fe:

$$P(M)=P(\mathrm{Mg})+P(\mathrm{Al})+P(\mathrm{Ca})+P(\mathrm{Fe})$$

Calculating peak intensity P(C) of C (carbon element): The total peak count number of mass numbers from 11.75 to 12.25 according to the ULVAC-PHI, Inc. standard software (Win Cadense) is given as the peak intensity P(C).

Calculating P(M)/P(C): P(M)/P(C) is calculated using the P(M) and P(C) calculated as shown above.

Measuring Acid Value and pKa of Polar Resin

The acid value of the polar resin is the number of mg of potassium hydroxide required to neutralize the acid contained in 1 g of sample. The acid value of the polar resin is measured in accordance with JIS K 0070-1992, specifically according to the following procedures.

First, titration is performed using a 0.1/mol/L potassium hydroxide ethyl alcohol solution (manufactured by Kishida Chemical Co., Ltd.). The factor of the potassium hydroxide ethyl alcohol solution can be determined using a potentiometric titrator (AT-510 (trade name) potentiometric titrator, manufactured by Kyoto Electronics Manufacturing Co., Ltd.).

Specifically, 100 ml of 0.100 mol/l hydrochloric acid is taken in a 250 ml tall beaker and titrated with the previous potassium hydroxide ethyl alcohol solution, and the amount of the potassium hydroxide ethyl alcohol solution required for neutralization is determined. The 0.100 mol/l hydrochloric acid is prepared in accordance with JIS K 8001-1998.

The measurement conditions for acid value measurement are as follows.

Titration unit: AT-510 potentiometric titrator (trade name, Kyoto Electronics Manufacturing Co., Ltd.)

Electrode: Double junction type composite glass electrode (Kyoto Electronics Manufacturing Co., Ltd.)

Control software for titration unit: AT-WIN

Titration analysis software: Tview

The titration parameters and control parameters for titration are set as follows.

Titration Parameters

Titration mode: Blank titration

Titration style: Full titration

Maximum titration amount: 20 ml

Waiting time before titration: 30 seconds

Titration direction: Automatic

Control Parameters

End point determination potential: 30 dE

End point determination potential value: 50 dE/dml

End point detection determination: Not set

Control speed mode: Standard

Gain: 1

Data collection potential: 4 mV

Data collection titration amount: 0.1 ml

Main Test 0.100 g of the measurement sample (polar resin) is measured exactly into a 250 ml tall beaker, 150 ml of a mixed toluene/ethanol (3:1) solution is added, and the sample is dissolved over the course of 1 hour. Titration is performed with the potassium hydroxide ethyl alcohol solution using the above potentiometric titrator.

Blank Test

Titration is performed by the same operations but using no sample (that is, using only a mixed toluene/ethanol (3:1) solution.

The results are entered into the following formula to calculate the acid value (Av) of the polar resin:

$$Av=[(C-B)\times f\times 5.61]/S$$

(in the formula, Av is the acid value (mg KOH/g), B is the added amount (ml) of the potassium hydroxide ethyl alcohol solution in the blank test, C is the added amount (ml) of the potassium hydroxide ethyl alcohol solution in the main test, f is the factor of the potassium hydroxide ethyl alcohol solution, and S is the mass (g) of the sample (polar resin).

Because the pKa is the same value as the pH at half the volume of the 0.1 mol/l potassium hydroxide ethyl alcohol solution required up to the neutralization point, the pH at half volume is read from the titration curve.

Measuring Glass Transition Temperature (Tg) of Polar Resin

The Tg of the polar resin is measured using a differential scanning calorimeter (DSC measurement unit).

Using a Q1000 differential scanning calorimeter (manufactured by TA Instruments), measurement is performed as follows according to ASTM D3418-82. 3 mg of the measurement sample (polar resin) is weighed precisely and placed in an aluminum pan, and an empty aluminum pan is used for reference. Equilibrium is maintained for 5 minutes at 20° C., after which measurement is performed in the measurement range of 20° C. to 180° C. at a ramp rate of 10° C./min. The glass transition temperature is determined by the midpoint method.

Measuring Polymer Conversion Rate of Polymerizable Monomer

The polymer conversion rate of the polymerizable monomer in the toner is measured as follows by gas chromatography (GC).

2.55 mg of DMF (dimethyl formamide) is added to 100 ml of acetone to prepare a solvent containing an internal standard. 0.2 g of the polymer slurry is then weighed exactly and made into a solution with 10 ml of the above solvent. This is treated for 30 minutes in an ultrasonic shaker and left standing for 1 hour. This is then filtered with a 0.5-μm membrane filter, and 4 μl of the filtrate is analyzed by gas chromatography.

A calibration curve is prepared in advance, and the mass ratio/area ratio of the polymerizable vinyl monomer and internal standard DMF is determined. The amount of unreacted polymerizable monomer is calculated from the resulting chromatogram and used to determine the polymer conversion rate.

The measurement unit and measurement conditions are as follows.

GC: Shimadzu Corporation GC-14A

Column: J&W Scientific DB-WAX (249 μm×0.25 μm×30 m)

Carrier gas: $N_2$ oven: (1) Hold for 2 minutes at 70° C., (2) raise temperature to 220° C. at 5° C./min Injection port: 200° C.

Split ratio: 1:20

Detector: 200° C. (FID)

surement was performed under the above conditions using this measurement sample.

Manufacturing Polyester Resins 2 to 4

Polyester resins 2 to 4 were manufactured by the same operations as the polyester resin 1 except that the input amounts of the acid component and alcohol component were changed as shown in Table 1. The reaction times were also adjusted appropriately to adjust the physical properties such as the acid value of each polyester resin.

TABLE 1

| | Monomer composition: input (molar ratios) | | | | | Physical properties of resin | | |
|---|---|---|---|---|---|---|---|---|
| | Acid | | | Alcohol | | | Acid value | |
| Polyester resin | TPA | IPA | TMA | BPA-PO | BPA-EO | Tg | mgKOH/g | pKa |
| Polyester resin 1 | 40.00 | 3.00 | 5.00 | 43.00 | 9.00 | 77.50 | 6 | 5.3 |
| Polyester resin 2 | 40.00 | 3.50 | 7.50 | 41.00 | 8.00 | 77.00 | 15 | 5.3 |
| Polyester resin 3 | 40.00 | 2.00 | 2.50 | 56.50 | 0.00 | 75.50 | 2 | 5.3 |
| Polyester resin 4 | 41.00 | 0.00 | 1.50 | 59.00 | 0.00 | 76.50 | 1 | 5.3 |

EXAMPLES

Examples of the invention are explained in detail below. The invention is not limited to these examples. Unless otherwise specified, parts in the examples and comparative examples are mass parts.

Manufacturing Polar Resin

Manufacturing Example of Polyester Resin 1

Monomers in the amounts shown in Table 1 were placed in a reaction tank equipped with a nitrogen introduction pipe, a dewatering pipe, a stirrer and a thermocouple, and dibutyl tin oxide as a catalyst were added in the amount of 1.5 parts per 100 parts of the total monomers. The temperature was then rapidly raised to 180° C. under normal pressure in a nitrogen atmosphere, and then raised at a rate of 10° C./hour between 180° C. and 210° C. to distill off the water and perform polycondensation.

Once the temperature had reached 210° C. the reaction tank was depressurized to not more than 5 kPa, and polycondensation was performed under conditions of 210° C., 5 kPa to obtain a polyester resin 1. The polymerization time was adjusted during this process so that the conversion rate of the resulting polyester resin Al was the value shown in Table 2 (126° C.). The physical properties of the polyester resin 1 are shown in Table 2.

Compositional analysis of the polyester 1 was performed by $^1$H-NMR. The specific measurement methods are as follow.

Measurement unit: JNM-EX400 FT-NMR unit (JEOL Ltd.)

Measurement frequency: 400 MHz

Pulse condition: 5.0 μs

Frequency range: 10500 Hz

Number of integrations: 64

Measurement temperature: 30° C.

50 mg of sample is placed in a sample tube with an internal diameter of 5 mm, deuterated chloroform ($CDCl_3$) is added as a solvent, and this is dissolved at 40° C. in a thermostatic tank to prepare a measurement sample. Mea- The Tg is in units of ° C. The abbreviations in the table are as follows.

TPA: Terephthalic acid

IPA: Isophthalic acid

TMA: Trimellitic acid

BPA-PO: Bisphenol A propylene oxide 2-mol adduct

BPA-EO: Bisphenol A ethylene oxide 2-mol adduct

Manufacturing Example of Polar Group-Containing Styrene Resin 1

300 parts of xylene (boiling point 144° C.) were added to a pressurizable and depressurizable flask and stirred as the system was thoroughly purged with nitrogen, and the temperature was raised to reflux.

A mixture of the following components was added under reflux and polymerized for 5 minutes at a polymerization temperature of 175° C. with a pressure of 0.100 MPa during the reaction.

| | |
|---|---|
| Styrene | 88.50 parts |
| Methyl methacrylate | 2.50 parts |
| 2-hydroxyethyl methacrylate | 5.00 parts |
| Methacrylic acid | 4.00 parts |
| Di-tert-butylperoxide | 2.00 parts |

A solvent removal step was then performed for 3 hours under reduced pressure to remove the xylene, and the product was pulverized to obtain a polar group-containing styrene resin 1.

Manufacturing Example of Polar Group-Containing Styrene Resin 2

A polar group-containing styrene resin 2 was obtained by changing the monomer composition ratios in the manufacturing example of the polar group-containing styrene resin 1 as shown in Table 2.

TABLE 2

| | Compositional ratio | | | | | Acid value | |
|---|---|---|---|---|---|---|---|
| | St | MMA | 2HEMA | MAA | Tg | mgKOH/g | pKa |
| Polar group-containing styrene resin 1 | 88.5 | 2.5 | 5.0 | 4.0 | 90.0 | 30 | 5.5 |
| Polar group-containing styrene resin 2 | 86.0 | 3.5 | 6.5 | 4.0 | 92.0 | 32 | 5.5 |
| Polar group-containing styrene resin 3 | Described in Description | | | | 68.9 | 18 | −0.6 |
| Polar group-containing styrene resin 4 | Described in Description | | | | 105.0 | 25 | 7.3 |

The Tg is in units of ° C. The abbreviations in the table are as follows.

St: Styrene

MMA: Methyl methacrylate

2HEMA: 2-hydroxyethyl methacrylate

MAA: Methacrylic acid

Manufacturing Example of Polar Group-Containing Styrene Resin 3

200 parts of xylene were placed in a reactor equipped with a stirrer, a condenser, a thermometer and a nitrogen introduction pipe, and refluxed in a flow of nitrogen. The following monomers were mixed, dripped into the reactor under stirring, and maintained for 10 hours.

| | |
|---|---|
| 2-acrylamido-2-methylpropane sulfonic acid | 6.0 parts |
| Styrene | 72.0 parts |
| 2-ethylhexyl acrylate | 18.0 parts |

The solvent was then distilled off, and the product was dried at 40° C. under reduced pressure to obtain a polar group-containing styrene resin 3.

Manufacturing Example of Polar Group-Containing Styrene Resin 4

Step 1 Intermediate Synthesis of Polymerizable Monomer M 100 g of 2,5-dihydroxybenzoic acid and 1441 g of 80% sulfuric acid were heated and mixed at 50° C. 144 g of tert-butyl alcohol were added to this dispersion, which was then stirred for 30 minutes at 50° C. The operation of adding 144 g of tert-butyl alcohol and stirring for 30 minutes was then performed 3 times.

The reaction solution was cooled to room temperature, and was slowly poured into 1 kg of ice water. The precipitate was filtered out, water washed, and then washed with hexane. This precipitate was dissolved in 200 mL of methanol, and re-precipitated with 3.6 L of water. After being filtered, this was dried at 80° C. to obtain 74.9 g of the salicylic acid intermediate represented by structural formula (2) below.

(2)

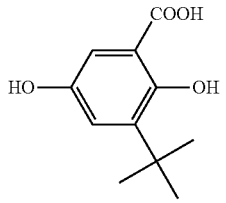

Step 2 Synthesis of Polymerizable Monomer M 25.0 g of the resulting salicylic acid intermediate was dissolved in 150 ml of methanol, 36.9 g of potassium carbonate were added, and the mixture was heated to 65° C. A mixture of 18.7 g of 4-(chloromethyl) styrene and 100 ml of methanol was dripped into this reaction solution, which was then reacted for 3 hours at 65° C. The reaction solution was cooled and filtered, and the filtrate was concentrated to obtain a coarse product. The coarse product was dispersed in 1.5 L of pH 2 water, and extracted by addition of ethyl acetate.

This was then water washed and dried with magnesium sulfate, and the ethyl acetate was distilled off under reduced pressure to obtain a precipitate. The precipitate was washed with hexane and purified by recrystallization with toluene and ethyl acetate to obtain 20.1 g of the polymerizable monomer M represented by structural formula (3) below.

(3)

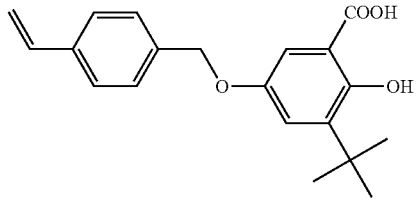

Step 3 Synthesis of Polar Group-Containing Styrene Resin 4

9.2 g of the polymerizable monomer M represented by structural formula (3) and 60.8 g of styrene were dissolved in 42.0 ml of DMF, stirred for 1 hour with nitrogen bubbling, and then heated to 110° C. A mixture of 45 ml of toluene and 1.8 g of tert-butyl peroxyisopropyl monocarbonate (NOF Corp., product name Perbutyl I) as an initiator was dripped into this reaction solution. This was then further reacted for 5 hours at 100° C. This was then cooled, and was dripped in 1 L of methanol to obtain a precipitate.

The resulting precipitate was dissolved in 120 ml of THF and was added dropwise to 1.80 L of methanol to precipitate a white precipitate, which was then filtered and dried under reduced pressure at 100° C. to obtain a polar group-containing styrene resin 4.

Manufacturing Toner 1

Preparation of Dispersion 100.0 parts of ion-exchange water, 2.0 parts of sodium phosphate and 0.9 parts of 10 mass % hydrochloric acid were added to a granulation tank to prepare a sodium phosphate aqueous solution that was then heated to 50° C. A calcium chloride aqueous solution of 1.2 parts of calcium chloride hexahydrate dissolved in 8.2 parts of ion-exchange water was then added to this granulation tank, and the mixture was stirred for 30 minutes at 25 m/s with a TK Homomixer (product name, Tokushu Kika Kogyo Co., Ltd.). A dispersion (aqueous dispersion) containing (fine particles of) calcium phosphate as a poorly water-soluble inorganic fine particle was obtained in this way (liquid dispersion preparation step).

Preparing Pigment Dispersion Composition

| | |
|---|---|
| Polymerizable monomer (styrene) | 39.0 parts |
| Colorant (C.I. pigment blue 15:3) | 7.0 parts |

These materials were introduced into an attritor (Nippon Coke & Engineering Co., Ltd.), and stirred for 180 minutes at 25° C., 200 rpm with zirconia beads 1.25 mm in diameter to prepare a pigment dispersion composition.

Preparation of Colorant-Containing Composition

The following materials were introduced into the same container, and mixed and dispersed at a peripheral speed of 20 m/s with a TK Homomixer (product name, Tokushu Kika Kogyo Co., Ltd.).

| | |
|---|---|
| Above pigment dispersion composition | 46.0 parts |
| Polymerizable monomer: styrene | 31.0 parts |
| Polymerizable monomer: n-butyl acrylate | 30.0 parts |
| Polar resin: polyester resin 1 | 2.0 parts |

This was further heated to 60° C., 10.0 parts of behenyl behenate were added as a release agent, and the mixture was dispersed and mixed for 30 minutes to prepare a colorant-containing composition.

Preparing Polymerizable Monomer Composition Particle

The above colorant-containing composition was added to a liquid dispersion containing calcium phosphate fine particles, and this was stirred at a temperature of 60° C. in a nitrogen atmosphere, at a peripheral speed of 30 m/s with a TK Homomixer (product name, Tokushu Kika Kogyo Co., Ltd.). 9.0 parts of the polymerization initiator t-butyl peroxypivalate (NOF Corp., product name "Perbutyl PV", molecular weight 174.2, 10-hour half-life temperature 58° C.) were added to this to prepare a liquid dispersion containing a polymerizable monomer composition particle (granulation step).

Preparing Toner Particle 1

The above liquid dispersion of the polymerizable monomer composition particle was transferred to another tank, stirred with a paddle stirring blade as the temperature was raised to 70° C., and reacted for 1 hour. The conversion rate of the polymerizable monomer here was 45.0%. This was reacted for a further 4 hours, and then reacted for 4 hours after the temperature had been raised to 80° C. (temperature increase step). The pH of the polymer slurry at this point was 5.0. Aluminum chloride was then added at 80° C. to a concentration of 2.0 mmol/L (addition step). The conversion rate of the polymerizable monomer at this point was 100.0%. This was then reacted under the same conditions for a further 2 hours. A polymer reaction solution (polymer slurry) containing a toner particle 1 was obtained in this way (polymerization step).

After completion of the polymerization step, supply of 120° C. steam to the polymer slurry at a flow rate of 5 kg/hr was initiated. After steam supply was initiated, distillation was initiated once 98° C. was reached, and distillation was performed for 8 hours (distillation step).

After completion of the distillation step, a 7.0 mass % aqueous sodium carbonate solution was added so that the pH of the polymer slurry was 8.5, and the slurry was maintained for 30 minutes at 80° C. (holding step (alkali treatment step)).

This was cooled, hydrochloric acid was added to a pH of 1.4, and the slurry was stirred for 2 hours to dissolve the poorly water-soluble inorganic fine particle on the toner particle surface. The toner particle dispersion was filtered out, water washed, and dried for 48 hours at 40° C. to obtain a toner particle 1 (washing/filtration/drying step).

A toner 1 having an inorganic fine powder on the surface was prepared as follows (external addition step).

1.5 parts of an inorganic fine powder were mixed with 100.0 parts of the toner particle 1 for 15 minutes at 3,000 rpm ($min^{-1}$) with a Henschel Mixer (Mitsui Miike Chemical Engineering Machinery Co., Ltd.) to obtain a toner 1 having the inorganic fine powder on the surface.

The inorganic fine powder was a hydrophobic silica fine particle (number-average particle diameter of primary particle 10 nm, BET specific surface area 170 $m^2/g$) that had been treated with dimethyl silicone oil (20 mass %) to improve flowability and triboelectrically charged to the same polarity (negative polarity) as the toner particle 1 before the inorganic fine particle was added.

Table 3 shows the polar resin and the various conditions for adding the water-soluble metal salt used in manufacturing the toner particle 1.

Manufacture of Toner 2

A toner particle 2 was obtained by the same manufacturing methods used for the toner 1 but with the changes shown in Table 3.

Moreover, a toner 2 was also obtained by the same external addition step as the toner 1 except that the 1.5 parts of the hydrophobic silica fine particle (number-average particle diameter of primary particle 10 nm, BET specific surface area 170 $m^2/g$) used in the external addition step of toner 1 were changed to a combination of 1.0 part of the hydrophobic silica fine particle and 0.5 parts of a strontium titanate fine particle (strontium titanate fine particle hydrophobically treated with 4.5 mass % isobutyl trimethoxysilane and 4.5% trifluoropropyl trimethoxysilane, number-average particle diameter of primary particle 35 nm, BET specific surface area 60 $m^2/g$).

Manufacturing Toners 3 to 21

Toner particles 3 to 21 were obtained by the same manufacturing methods used for the toner 1 but with the changes shown in Table 3. Toners 3 to 21 were also obtained by the same external addition step as the toner 1.

The pH of the slurry before the water-soluble metal salt addition step was controlled by adding 10 mass % sodium carbonate aqueous solution.

TABLE 3

| Toner particle No. | Polar resin | Water-soluble metal salt | Water-soluble metal salt concentration mmol/L | Conversion rate when adding water-soluble metal salt (%) | pH of slurry before water-soluble metal salt addition step | pH in alkali treatment step |
|---|---|---|---|---|---|---|
| 1 | Polyester resin 1 | Aluminum chloride | 2.0 | 100 | 5.0 | 8.5 |
| 2 | Polyester resin 2 | Aluminum chloride | 2.0 | 100 | 5.0 | 8.5 |
| 3 | Polyester resin 1 | Aluminum chloride | 0.2 | 100 | 5.0 | 8.5 |
| 4 | Polyester resin 1 | Aluminum chloride | 40.0 | 100 | 5.0 | 8.5 |
| 5 | Polyester resin 3 | Aluminum chloride | 1.0 | 100 | 5.0 | 8.5 |
| 6 | Polar group-containing styrene resin 1 | Aluminum chloride | 2.0 | 100 | 5.0 | 8.5 |
| 7 | Polyester resin 1 | Aluminum chloride | 0.1 | 100 | 5.0 | 8.5 |
| 8 | Polyester resin 1 | Aluminum chloride | 45.0 | 100 | 5.0 | 8.5 |
| 9 | Polyester resin 4 | Aluminum chloride | 1.0 | 100 | 5.0 | 8.5 |
| 10 | Polar group-containing styrene resin 2 | Aluminum chloride | 2.0 | 100 | 5.0 | 8.5 |
| 11 | Polyester resin 1 | Iron chloride (III) | 2.0 | 100 | 5.0 | 8.5 |
| 12 | Polyester resin 1 | Magnesium chloride | 2.0 | 100 | 5.0 | 8.5 |
| 13 | Polyester resin 1 | Calcium chloride | 2.0 | 100 | 5.0 | 8.5 |
| 14 | Polar group-containing styrene resin 3 | Aluminum chloride | 2.0 | 100 | 4.0 | 7.5 |
| 15 | Polar group-containing styrene resin 4 | Aluminum chloride | 2.0 | 100 | 6.0 | 10.0 |
| 16 | Polyester resin 1 | Aluminum chloride | 2.0 | 100 | 8.5 | 8.5 |
| 17 | Polyester resin 1 | Aluminum chloride | 2.0 | 75 | 5.0 | 8.5 |
| 18 | Polyester resin 1 | Aluminum chloride | 2.0 | 60 | 5.0 | 8.5 |
| 19 | Polyester resin 1 | Aluminum chloride | 2.0 | 50 | 5.0 | 8.5 |
| 20 | Polyester resin 1 | Aluminum chloride | 2.0 | 30 | 5.0 | 8.5 |
| 21 | Polyester resin 1 | Aluminum chloride | 2.0 | 0 | 5.0 | 8.5 |

Manufacturing Toner 22

Manufacturing Polyester Resin 5

20 parts of propylene oxide-modified bisphenol A (2-mol adduct), 80 parts of propylene oxide-modified bisphenol A (3-mol adduct), 80 parts of terephthalic acid, 20 parts of isophthalic acid and 0.50 parts of tetrabutoxy titanium were placed in a reaction apparatus equipped with a stirrer, a thermometer and an outflow cooler, and an esterification reaction was performed at 190° C. 1 part of trimellitic anhydride (TMA) was then added, the temperature was raised to 220° C. as the pressure inside the system was gradually reduced, and a polycondensation reaction was performed at 150 Pa to obtain a polyester resin 5. The polyester resin 5 had an acid value of 12 mg KOH/g and a Tg of 57° C.

Preparation of Binder Resin Particle Dispersion 1

| | |
|---|---|
| Polyester resin 5 | 200.0 parts |
| Ion-exchange water | 500.0 parts |

These materials were placed in a stainless-steel container, heated and melted at 95° C. in a warm bath, and thoroughly stirred at 7800 rpm with a Homogenizer (IKA Ultra-Turrax T50) as 0.1 mol/L sodium hydrogen carbonate was added to raise the pH above 7.0. A mixed solution of 3 parts of sodium dodecylbenzene sulfonate and 297 parts of ion-exchange water was then dripped in slowly to emulsify and disperse the mixture and obtain a binder resin particle dispersion 1.

When the particle size distribution of this binder resin particle dispersion 1 was measured with a particle size measuring device (Horiba LA-920), the number-average particle diameter of the contained binder resin particles was 0.25 μm, and no coarse particles larger than 1 μm were observed.

Preparing Wax Particle Dispersion

| | |
|---|---|
| Ion-exchange water | 500.0 parts |
| Wax (behenyl behenate, melting point 72.1° C.) | 250.0 parts |

These materials were placed in a stainless-steel container, heated and melted at 95° C. in a warm bath, and thoroughly stirred at 7800 rpm with a Homogenizer (IKA Ultra-Turrax T50) as 0.1 mol/L sodium hydrogen carbonate was added to raise the pH above 7.0. A mixed solution of 5 parts of sodium dodecylbenzene sulfonate and 245 parts of ion-exchange water was then dripped in slowly to emulsify and disperse the mixture.

When the particle size distribution of the wax particles contained in this wax particle dispersion was measured with a particle size measuring device (Horiba LA-920), the number-average particle diameter of the contained wax particles was 0.35 μm, and no coarse particles larger than 1 μm were observed.

Preparation of Colorant Particle Dispersion

| | |
|---|---|
| C.I. pigment blue 15:3 | 100.0 parts |
| Sodium dodecylbenzene sulfonate | 5.0 parts |
| Ion-exchange water | 400.0 parts |

These materials were mixed, and then dispersed with a hand grinder mill. When the particle size distribution of the colorant particles contained in this colorant particle dispersion was measured with a particle size measuring device (Horiba LA-920), the number-average particle diameter of the contained colorant particles was 0.2 μm, and no coarse particles larger than 1 μm were observed.

Preparation of Toner Particle 22

| | |
|---|---|
| Binder resin particle dispersion 1 | 500.0 parts |
| Colorant particle dispersion | 50.0 parts |
| Wax particle dispersion | 50.0 parts |
| Sodium dodecylbenzene sulfonate | 5.0 parts |

The binder resin particle dispersion 1, wax particle dispersion and sodium dodecylbenzene sulfonate were loaded into a reactor (1-L flask, baffled anchor wing), and uniformly mixed. Meanwhile the colorant particle dispersion was uniformly mixed in a 500 ml beaker and stirred while being gradually added to the reactor to obtain a mixed dispersion. The resulting mixed dispersion was stirred as a magnesium sulfate aqueous solution was dripped in in the amount of 1.0 parts as solids to form aggregated particles.

After completion of dripping the system was purged with nitrogen and maintained at 50° C. for 1 hour and at 55° C. for 1 hour. Aluminum chloride was added to a concentration of 2.0 mmol/L at 55° C.

The temperature was then raised, 7.0 mass % sodium carbonate aqueous solution was added at 80° C. to a pH of 8.5, and the system was maintained at 80° C. for 30 minutes. The temperature was then lowered to 63° C. and maintained for 3 hours to form fused particles. This reaction was performed in a nitrogen atmosphere. After a predetermined amount of time, the temperature was lowered to room temperature at a cooling rate of 0.5° C./min.

After cooling, the reaction product was subjected to solid-liquid separation at 0.4 MPa of pressure in a 10 L pressure filter, to obtain a toner cake. Ion-exchange water was then added until the pressure filter was full, and the cake was washed under 0.4 MPa of pressure. The same washing was then repeated, for a total of 3 washings. This toner cake was dispersed in 1000 parts of a mixed 50:50 methanol/water solvent containing 0.15 parts of a dissolved nonionic surfactant to obtain a surface-treated toner particle dispersion.

This toner particle dispersion was poured into a pressure filter, and 5 L of ion-exchange water were added. Solid-liquid separation was then performed under 0.4 MPa of pressure, and fluidized bed drying was performed at 45° C. to obtain a toner particle 1.

External Addition Step

Toner particle 22 was obtained as in the toner particle 1 external addition step except that the toner particle 22 was used.

Manufacturing Toner 23

Preparing Binder Resin Particle Dispersion 2

78.0 parts of styrene, 20.7 parts of butyl acrylate, 1.3 parts of acrylic acid as a carboxyl group-donating monomer and 3.2 parts of n-laurylmercaptane were mixed and dissolved. An aqueous solution of 1.5 parts of Neogen RK (DKS Co., Ltd.) dissolved in 150 parts of ion-exchange water was added to this solution, and dispersed.

This was then stirred slowly for 10 minutes as an aqueous solution of 0.3 parts of potassium persulfate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a binder resin particle dispersion 2 with a solids concentration of 12.5 mass % and a volume-based median diameter of 0.2 μm.

Preparation of Toner Particle 23

| | |
|---|---|
| Binder resin particle dispersion 2 | 500 parts |
| Colorant particle dispersion | 50 parts |
| Wax particle dispersion | 50 parts |
| Sodium dodecylbenzene sulfonate | 5 parts |

The binder resin particle dispersion 2, wax particle dispersion and sodium dodecylbenzene sulfonate were loaded into a reactor (1-L flask, baffled anchor wing), and uniformly mixed. Meanwhile the colorant particle dispersion was uniformly mixed in a 500 ml beaker and stirred while being gradually added to the reactor to obtain a mixed dispersion. The resulting mixed dispersion was stirred as a magnesium sulfate aqueous solution was dripped in in the amount of 1.0 parts as solids to form aggregated particles.

After completion of dripping the system was purged with nitrogen and maintained at 50° C. for 1 hour and at 55° C. for 1 hour. Aluminum chloride was added to a concentration of 2.0 mmol/L at 55° C.

The temperature was then raised, 7.0 mass % sodium carbonate aqueous solution was added at 80° C. to a pH of 8.5, and the system was maintained at 80° C. for 30 minutes. The temperature was then lowered to 63° C. and maintained for 3 hours to form fused particles. This reaction was performed in a nitrogen atmosphere. After a predetermined amount of time, the temperature was lowered to room temperature at a cooling rate of 0.5° C./min.

After cooling, the reaction product was subjected to solid-liquid separation at 0.4 MPa of pressure in a 10 L pressure filter, to obtain a toner cake. Ion-exchange water was then added until the pressure filter was full, and the cake was washed under 0.4 MPa of pressure. The same washing was then repeated, for a total of 3 washings. This toner cake was dispersed in 1000 parts of a 50:50 mixed methanol/water solvent containing 0.15 parts of a dissolved nonionic surfactant to obtain a surface treated toner particle dispersion.

This toner particle dispersion was poured into a pressure filter, and 5 L of ion-exchange water were added. This was then subjected to solid-liquid separation under 0.4 MPa of pressure followed by fluidized bed drying at 45° C. to obtain a toner particle 23.

External Addition Step

Toner 23 was obtained by the same external addition step used for the toner particle 1 but using the toner particle 23.

Manufacturing Toner 24

Preparing Toner Particle 24

| | |
|---|---|
| Polyester resin 5 | 100 parts |
| Wax (behenyl behenate, melting point 72.1° C.) | 10 parts |
| C.I. pigment blue 15:3 | 6 parts |
| Ethyl acetate | 200 parts |

These components were dispersed for 10 hours in a ball mill, and the resulting dispersion was added to 2000 parts of ion-exchange water containing 3.5 mass % of tricalcium phosphate and granulated for 10 minutes at 15000 rpm in a TK Homomixer high speed mixing apparatus. This was then maintained for 4 hours at 75° C. in a water bath under stirring at 150 rpm with a three-one motor to remove the solvent.

Aluminum chloride was then added to a concentration of 2.0 mmol/L, and the temperature was raised to 80° C. 7.0 mass % of sodium carbonate aqueous solution was added at 80° C. until the pH was 8.5, and the temperature was maintained at 80° C. for 30 minutes. The slurry was cooled, hydrochloric acid was added to give the cooled slurry a pH of 1.4, and the slurry was stirred for 1 hour to dissolve the calcium phosphate salt. This was then washed with 10 times the water volume of the slurry, filtered and dried, and then classified to adjust the particle diameter and obtain a toner particle 24.

External Addition Step

Toner 24 was obtained by the same external addition step used for the toner particle 1 but using the toner particle 24.

Manufacturing Toner 25

The following materials were substituted when preparing the colorant-containing composition used to manufacture the toner 1, and no aluminum chloride was added in the polymerization step.

| | |
|---|---|
| Pigment dispersion composition | 46.0 parts |
| Polymerizable monomer: styrene | 39.0 parts |

-continued

| | |
|---|---|
| Polymerizable monomer: n-butyl acrylate | 22.0 parts |
| Polar resin: polyester resin 1 | 2.0 parts |

Also, cooling was performed without alkali treatment after completion of the distillation step. Toner 25 was obtained in the same way as the toner 1 except for these steps.

Manufacturing Toner 26

No aluminum chloride was added in the polymerization step in the manufacture of the toner 1. Also, cooling was performed without alkali treatment after completion of the distillation step. Toner 26 was obtained in the same way as the toner 1 except for these steps.

Manufacturing Toner 27

The following materials were substituted when preparing the colorant-containing composition used to manufacture the toner 1, and no aluminum chloride was added in the polymerization step.

| | |
|---|---|
| Pigment dispersion composition | 46.0 parts |
| Polymerizable monomer: styrene | 31.0 parts |
| Polymerizable monomer: n-butyl acrylate | 30.0 parts |
| Polar resin: polyester resin 1 | 2.0 parts |
| Aluminum distearate | 1.0 parts |

Also, cooling was performed without alkali treatment after completion of the distillation step. Toner 27 was obtained in the same way as the toner 1 except for these steps.

Manufacturing Toner 28

When preparing the toner particle 22 in the manufacturing example of the toner 22, the temperature was maintained for 1 hour at 50° C. and for 1 hour at 55° C. after aggregate particle formation, and no aluminum chloride was added. Toner 28 was obtained in the same way as the toner 22 except for these steps.

Manufacturing Toner 29

Manufacturing Polyester Resin 6

20 parts of propylene oxide-modified bisphenol A (2-mol adduct), 80 parts of propylene oxide-modified bisphenol A (3-mol adduct), 20 parts of terephthalic acid, 80 parts of fumaric acid 0.50 parts of tetrabutoxy titanium were placed in a reaction unit equipped with a stirrer, a thermometer and an outflow cooler, and an esterification reaction was performed at 190° C.

1 part of trimellitic anhydride (TMA) was then added, the temperature was raised to 220° C. as the system was gradually depressurized, and a polycondensation reaction was performed at 150 Pa to obtain a polyester resin 6. The polyester resin 6 had an acid value of 11 mg KOH/g, and a Tg of 62° C.

Preparing Binder Resin Particle Dispersion 3

| | |
|---|---|
| Polyester resin 6 | 200.0 parts |
| Ion-exchange water | 500.0 parts |

These materials are placed in a stainless-steel container, heated and melted to 95° C. in a warm bath, and thoroughly stirred at 7800 rpm with a Homogenizer (IKA Ultra-Turrax T50) as 0.1 mol/L sodium hydrogen carbonate was added to raise the pH above 7.0. A mixed solution of 3.5 parts of sodium dodecylbenzene sulfonate and 297 parts of ion-exchange water was then dripped in slowly to emulsify and disperse the mixture and obtain a binder resin particle dispersion 3.

When the particle size distribution of this binder resin particle dispersion 3 was measured with a particle size measuring device (Horiba LA-920), the number-average particle diameter of the contained binder resin particles was 0.19 μm, and no coarse particles larger than 1 μm were observed.

Preparing Toner Particle 29

| | |
|---|---|
| Binder resin particle dispersion 1 | 150.0 parts |
| Binder resin particle dispersion 3 | 150.0 parts |
| Colorant particle dispersion | 50.0 parts |
| Wax particle dispersion | 50.0 parts |
| Sodium dodecylbenzene sulfonate | 5.0 parts |

The binder resin particle dispersion 1, binder resin particle dispersion 3, wax particle dispersion and sodium dodecylbenzene sulfonate were loaded into a reactor (1-L flask, baffled anchor wing), and uniformly mixed. Meanwhile the colorant particle dispersion was uniformly mixed in a 500 ml beaker and stirred while being gradually added to the reactor to obtain a mixed dispersion. The resulting mixed dispersion was stirred as a magnesium sulfate aqueous solution was dripped in in the amount of 1.0 parts as solids to form aggregated particles. Once the particle diameter had reached 5.0 μm, a mixture of 100 parts of the binder resin particle dispersion 1 and 100 parts of the binder resin particle dispersion 3 was added and maintained for 60 minutes.

The temperature was then raised to 85° C., 3 parts of sodium hydroxyiminodisuccinate were added, and a sodium hydroxide aqueous solution was added until the pH was 9.0. A solution of 15 parts of potassium persulfate (KPS) dissolved in 150 parts of ion-exchange water was then added, and the mixture was maintained at 85° C. for 30 minutes. After a predetermined amount of time the mixture was cooled to room temperature at a rate of 0.5° C. per minute.

After cooling, the reaction product was subjected to solid-liquid separation under 0.4 MPa of pressure in a 10-L pressure filter to obtain a toner cake. Ion-exchange water was then added until the pressure filter was full, and the cake was washed under 0.4 MPa of pressure. Washing was then performed in the same way, for a total of 3 washings. This toner cake was dispersed in 1000 parts of a 50:50 mixed methanol/water solvent containing 0.15 parts of a dissolved nonionic surfactant to obtain a surface treated toner particle dispersion.

This toner particle dispersion was poured into a pressure filter, and 5 L of ion-exchange water were added. This was then subjected to solid-liquid separation under 0.4 MPa of pressure followed by fluidized bed drying at 45° C. to obtain a toner particle 29.

External Addition Step

A toner 29 was obtained by the same external addition step used for the toner particle 1 but using the toner particle 29.

Manufacturing Toner 30

Manufacturing Polyester Resin 7

20 parts of propylene oxide-modified bisphenol A (2-mol adduct), 70 parts of propylene oxide-modified bisphenol A (3-mol adduct), 20 parts of ethylene glycol, 80 parts of terephthalic acid, 20 parts of isophthalic acid and 0.50 parts of tetrabutoxy titanium were placed in a reaction unit equipped with a stirrer, a thermometer and an outflow cooler, and an esterification reaction was performed at 190° C.

1 part of trimellitic anhydride (TMA) was then added, the temperature was raised to 220° C. as the pressure inside the system was gradually reduced, and a polycondensation reaction was performed at 150 Pa to obtain a polyester resin 7. The polyester resin 7 had an acid value of 11 mg KOH/g and a Tg of 39° C.

Preparing Binder Resin Particle Dispersion 4

| | |
|---|---|
| Polyester resin 7 | 200.0 parts |
| Ion-exchange water | 500.0 parts |

These materials are placed in a stainless-steel container, heated and melted to 95° C. in a warm bath, and thoroughly stirred at 7800 rpm with a Homogenizer (IKA Ultra-Turrax T50) as 0.1 mol/L sodium hydrogen carbonate was added to raise the pH above 7.0. A mixed solution of 3.5 parts of sodium dodecylbenzene sulfonate and 297 parts of ion-exchange water was then dripped in slowly to emulsify and disperse the mixture and obtain a binder resin particle dispersion 4.

When the particle size distribution of this binder resin particle dispersion 4 was measured with a particle size measuring device (LA-920 manufactured by Horiba, Ltd.), the number-average particle diameter of the contained binder resin particles was 0.17 μm, and no coarse particles larger than 1 μm were observed.

Preparing Toner Particle 30

Toner particle 30 was obtained in the same way as the toner particle 29 except that the binder resin particle dispersion 4 was substituted for the binder resin particle dispersion 3.

External Addition Step

Toner 30 was obtained by the same external addition step used for the toner particle 1 but using the toner particle 30.

Manufacturing Toner 31

Preparing Binder Resin Particle Dispersion 5

73.0 parts of styrene, 15.7 parts of methyl acrylate, 3.1 parts of methacrylic acid as a carboxyl group-donating monomer and 1.5 parts of n-lauryl mercaptane were mixed and dissolved. An aqueous solution of 1.5 parts of Neogen RK (DKS Co., Ltd.) dissolved in 150 parts of ion-exchange water was added to this solution, and dispersed. This was then stirred slowly for 10 minutes as an aqueous solution of 0.15 parts of potassium persulfate in 10 parts of ion-exchange water was added. After nitrogen purging, emulsion polymerization was performed for 6 hours at 70° C. After completion of polymerization, the reaction solution was cooled to room temperature, and ion-exchange water was added to obtain a binder resin particle dispersion 5 with a solids concentration of 12.5 mass % and a volume-based median diameter of 0.15 μm.

Preparing Toner Particle 31

| | |
|---|---|
| Binder resin particle dispersion 5 | 475.0 parts |
| Colorant particle dispersion | 50.0 parts |
| Wax particle dispersion | 50.0 parts |
| Sodium dodecylbenzene sulfonate | 5.0 parts |

The binder resin particle dispersion 5, wax particle dispersion and sodium dodecylbenzene sulfonate were loaded into a reactor (1-L flask, baffled anchor wing), and uniformly mixed. Meanwhile the colorant particle dispersion was uniformly mixed in a 500 ml beaker and stirred while being gradually added to the reactor to obtain a mixed dispersion. The resulting mixed dispersion was stirred as a magnesium sulfate aqueous solution was dripped in in the amount of 1.0 parts as solids to form aggregated particles. Once the particle diameter had reached 5.0 μm, 25 parts of the binder resin particle dispersion 5 were added and maintained for 60 minutes.

After completion of dripping the system was purged with nitrogen and maintained at 50° C. for 1 hour and at 55° C. for 1 hour. The temperature was then lowered to 63° C. and maintained for 3 hours to form fused particles. This reaction was performed in a nitrogen atmosphere. After a predetermined amount of time, the temperature was lowered to room temperature at a cooling rate of 0.5° C./min.

After cooling, the reaction product was subjected to solid-liquid separation at 0.4 MPa of pressure in a 10 L pressure filter, to obtain a toner cake. Ion-exchange water was then added until the pressure filter was full, and the cake was washed under 0.4 MPa of pressure. This was washed again in the same way, a total of 3 times. This toner cake was dispersed in 1000 parts of a mixed 50:50 methanol/water solvent containing 0.15 parts of a dissolved nonionic surfactant to obtain a surface-treated toner particle dispersion.

This toner particle dispersion was poured into a pressure filter, and 5 L of ion-exchange water were added. Solid-liquid separation was then performed under 0.4 MPa of pressure, and fluidized bed drying was performed at 45° C. to obtain a toner particle 31.

External Addition Step

Toner 31 was obtained by the same external addition step used for the toner particle 1 but using the toner particle 31.

Image Evaluation

A modified LBP712Ci (Canon Inc.) was used as the evaluation apparatus. The process speed of the main unit was modified to 270 mm/sec. The necessary adjustments were then made to allow image formation under these conditions. The toner was removed from the black cartridge, which was then filled with 200 g of the toner 1.

Fogging Durability Evaluation in High-Temperature, High-Humidity Environment

Fogging was evaluated in a high-temperature, high-humidity environment (30° C., 80% RH). Xerox 4200 paper (Xerox Co., 75 g/m$^2$) was used as the evaluation paper.

Intermittent durable printing was performed by printing 20000 sheets of a letter E image with a print percentage of 1% at an output rate of 2 sheets every 4 seconds in a high-temperature, high-humidity environment.

A solid white image was then output, and given Ds as the worst value for reflection density of the white background and Dr as the average reflection density of the transfer material before image formation, Dr−Ds was given as the fogging value.

The reflection density of the white background was measured with a reflection densitometer (Reflectometer model TC-6DS, Tokyo Denshoku Co., Ltd.) using an amber light filter.

A lower value indicates a better fogging level. The evaluation standard is as follows.

Evaluation Standard

A: Less than 0.5%

B: At least 0.5% and less than 1.5%

C: At least 1.5% and less than 3.0%

D: At least 3.0%

Evaluation of Development Streaks

Development streaks are roughly 0.5 mm vertical streaks that occur due to toner crushing or cracking, and this image defect is easily observed when a full-page halftone image is output.

Development streaks were evaluated in a low-temperature, low-humidity environment (15° C., 10% RH).

Xerox 4200 paper (Xerox Co., 75 g/m$^2$) was used as the evaluation paper.

Intermittent durable printing was performed by printing 20000 sheets of a letter E image with a print percentage of 1% at an output rate of 2 sheets every 4 seconds in a low-temperature, low-humidity environment. A full-page halftone image was then output, and the presence or absence of streaks was observed. The results are shown in Table 4.

Evaluation Standard

A: No streaks

B: Development streaks in 1 to 3 locations

C: Development streaks in 4 to 6 locations

D: Development streaks in at least 7 locations, or development streaks 0.5 mm or more in width Low Temperature Fixability Using an LBP712Ci color laser printer (Canon Inc.) from which the fixing unit had been removed, the toner was removed from the black cartridge, which was then filled with the toner for evaluation. Color laser copy paper (Canon Inc., 80 g/m$^2$) was used as the recording medium. Using the new toner, an unfixed image 2.0 cm long and 15.0 cm wide was then formed with a toner laid-on level of 0.20 mg/cm$^2$ in the part 1.0 cm from the upper edge of the paper in the direction of paper feed. The removed fixing unit was then modified so that the fixing temperature and process speed could be adjusted and used to perform a fixing test of the unfixed image.

The process speed was first set to 270 mm/s and the fixing line pressure to 27.4 kgf in a normal-temperature, normal-humidity environment (23° C., 60% RH), and the set temperature was raised in 5° C. increments from an initial temperature of 110° C. as the unfixed image was fixed at each temperature.

The evaluation standard for low temperature fixability is as follows. The low temperature fixing initiation point is the lowest temperature at which the image density decrease after abrasion is not more than 10.0% when the surface of the image is rubbed 5 times at a rate of 0.2 m/second with Silbon paper (Dusper K-3) under 4.9 kPa (50 g/cm$^2$) of load. When proper fixing is not achieved, the image density decrease rate tends to increase. Image density is measured using a 500 series spectral densitometer (X-Rite Inc.).

Evaluation Standard

A: Low temperature fixing initiation point not more than 120° C.

B: Low temperature fixing initiation point 125° C. or 130° C.

C: Low temperature fixing initiation point 135° C. or 140° C.

D: Low temperature fixing initiation point at least 145° C.

Examples 1 to 24

In examples 1 to 24, the above image evaluation, toner storage elastic modulus measurement, surface viscoelasticity measurement and surface metal content measurement were performed on the toners 1 to 24. The results are shown in Table 4.

Comparative Examples 1 to 6

In comparative examples 1 to 6, the above image evaluation, toner storage elastic modulus measurement, surface viscoelasticity measurement and surface metal content measurement were performed on the toners 25 to 30. The results are shown in Table 4.

TABLE 4

| | | Evaluation result | | | Tone properties | | Toner particle properties | | |
|---|---|---|---|---|---|---|---|---|---|
| Example No. | Toner No. | Low temperature fixability | Fogging | Development streaks | Storage elastic modulus MPa | Surface storage elastic modulus GPa under load 150 μN | Surface storage elastic modulus GPa under load 30 μN | Surface loss modulus under load 30 μN GPa | P(M)/P(C) |
| 1 | 1 | A 115° C. | A 0.4% | A | 1.05 | 3.49 | 5.65 | 0.62 | 5.4 |
| 2 | 2 | A 120° C. | A 0.4% | A | 1.91 | 3.57 | 5.81 | 0.45 | 12.9 |
| 3 | 3 | A 110° C. | B 1.2% | A | 0.83 | 3.02 | 4.52 | 0.99 | 2.5 |
| 4 | 4 | A 120° C. | A 0.2% | A | 2.20 | 3.85 | 6.48 | 0.48 | 29.3 |
| 5 | 5 | A 110° C. | B 1.4% | B | 0.66 | 2.95 | 4.59 | 1.11 | 2.1 |
| 6 | 6 | C 135° C. | A 0.3% | B | 2.83 | 4.34 | 7.83 | 0.29 | 24.5 |
| 7 | 7 | A 110° C. | C 1.7% | B | 0.72 | 2.82 | 4.41 | 1.05 | 1.6 |
| 8 | 8 | B 130° C. | A 0.2% | A | 2.34 | 3.92 | 6.60 | 0.42 | 33.5 |
| 9 | 9 | A 110° C. | C 2.2% | C | 0.41 | 2.83 | 4.28 | 1.23 | 1.3 |
| 10 | 10 | C 140° C. | A 0.2% | C | 2.97 | 4.47 | 7.95 | 0.26 | 25.0 |
| 11 | 11 | A 115° C. | B 1.3% | A | 0.95 | 3.08 | 4.71 | 0.59 | 6.1 |
| 12 | 12 | A 115° C. | C 1.8% | B | 0.81 | 2.89 | 4.33 | 0.33 | 6.6 |
| 13 | 13 | A 115° C. | C 1.9% | B | 0.83 | 2.95 | 4.24 | 0.38 | 5.8 |
| 14 | 14 | B 125° C. | A 0.3% | B | 2.50 | 3.87 | 7.01 | 0.34 | 10.2 |
| 15 | 15 | C 140° C. | A 0.1% | A | 2.63 | 4.32 | 7.53 | 0.35 | 24.3 |
| 16 | 16 | A 115° C. | A 0.3% | A | 1.02 | 3.43 | 5.71 | 0.6 | 5.6 |
| 17 | 17 | A 115° C. | A 0.4% | A | 1.07 | 3.33 | 5.60 | 0.65 | 5.0 |

TABLE 4-continued

| | | Evaluation result | | | Tone properties | | Toner particle properties | | |
|---|---|---|---|---|---|---|---|---|---|
| Example No. | Toner No. | Low temperature fixability | Fogging | Development streaks | Storage elastic modulus MPa | Surface storage elastic modulus GPa under load 150 μN | Surface storage elastic modulus GPa under load 30 μN | Surface loss modulus under load 30 μN GPa | P(M)/P(C) |
| 18 | 18 | A 115° C. | B 0.8% | A | 1.17 | 3.12 | 5.33 | 0.45 | 3.9 |
| 19 | 19 | A 120° C. | B 1.2% | A | 1.14 | 3.15 | 5.29 | 0.46 | 4.1 |
| 20 | 20 | A 120° C. | C 1.6% | C | 1.25 | 2.99 | 4.83 | 0.25 | 2.3 |
| 21 | 21 | A 120° C. | C 2.3% | C | 1.26 | 2.95 | 4.70 | 0.23 | 2.4 |
| 22 | 22 | A 105° C. | C 2.8% | C | 0.21 | 2.81 | 4.01 | 0.22 | 39.8 |
| 23 | 23 | A 110° C. | C 2.2% | C | 0.53 | 2.93 | 4.22 | 0.2 | 30.3 |
| 24 | 24 | A 110° C. | C 2.1% | C | 0.55 | 3.10 | 4.39 | 0.56 | 6.1 |
| C.E. 1 | 25 | D 145° C. | A 0.1% | A | 3.25 | 3.51 | 5.65 | 0.35 | 0.2 |
| C.E. 2 | 26 | A 110° C. | D 7.0% | C | 1.02 | 2.43 | 3.58 | 1.10 | 0.2 |
| C.E. 3 | 27 | A 115° C. | D 3.1% | D | 1.06 | 2.45 | 3.53 | 0.20 | 36.1 |
| C.E. 4 | 28 | A 105° C. | D 9.2% | D | 0.09 | 2.08 | 3.12 | 0.21 | 0.0 |
| C.E. 5 | 29 | D 145° C. | A 0.1% | B | 3.15 | 4.63 | 7.00 | 0.19 | 0.0 |
| C.E. 6 | 30 | C 135° C. | C 2.9% | D | 2.85 | 2.63 | 3.79 | 0.22 | 0.0 |
| C.E. 7 | 31 | B 125° C. | D 6.8% | D | 2.58 | 2.55 | 3.68 | 0.98 | 0.0 |

In the table, "C.E." denotes "Comparative example", and "storage elastic modulus MPa" means the storage elastic modulus at 70 C. in dynamic viscoelasticity measurement of the toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-090407, filed May 13, 2019, which is hereby incorporated by reference herein in its entirety.

What is claimed is:

1. A toner, comprising:

a toner particle that includes a binder resin, and having a toner particle surface formed by crosslinking a polar polyester resin A with a polyvalent metal;

polar resin A having an acid value of 2 to 30 mg KOH/g and the polyvalent metal being at least one member selected from the group consisting of Al, Ca, Mg and Fe, wherein the storage elastic modulus of the toner in dynamic viscoelasticity measurement at 70° C. is 0.10 to 3.00 MPa, and the surface storage elastic modulus of the toner in nanoindentation measurement at 25° C. under 150 μN load is 2.80 to 4.50 GPa.

2. The toner according to claim 1, wherein the surface storage elastic modulus of the toner in nanoindentation measurement at 25° C. under 30 μN load is 3.50 to 8.00 GPa.

3. The toner according to claim 1, wherein the surface loss modulus of the toner in nanoindentation measurement at 25° C. under 30 μN load is 0.25 to 1.20 GPa.

4. The toner according to claim 1, wherein $2.0 \leq P(M)/P(C) \leq 30.0$ when P(M) is the total of the peak intensities of Mg, Al, Ca and Fe obtained by time-of-flight secondary ion mass spectrometry (TOF-SIMS) of the toner particle, and P(C) is the peak intensity of C obtained by TOF-SIMS of the toner particle.

5. The toner according to claim 1, further comprising an external additive.

6. A method for manufacturing the toner according to claim 1, comprising the steps of:

an aqueous granulation step forming particles of a polymerizable monomer composition containing resin A and a polymerizable monomer for producing the binder resin; and polymerizing the polymerizable monomer contained in the polymerizable monomer composition particles to produce resin particles, wherein the polymerization step includes an addition step in which a water-soluble metal salt of a divalent or higher metal is added to the aqueous medium, and maintaining the aqueous medium containing the resulting resin particles at a pH of 7.5 to 10.0, and polar resin A has an acid group, and the acid dissociation constant pKa of polar resin A is not more than 7.5.

7. The method according to claim 6, wherein the addition step is performed with a polymer conversion rate of 50 to 100% of the polymerizable monomer.

8. The method according to claim 6, wherein the addition step is performed with a polymer conversion rate of 75 to 100% of the polymerizable monomer.

9. The method according to claim 6, wherein the water-soluble metal salt is at least one salt of a metal selected from the group consisting of Al, Ca, Mg and Fe.

10. The method according to claim 6, wherein the polymerizable monomer is at least one member selected from the group consisting of styrene monomers and (meth)acrylic acid ester monomers.

11. The method according to claim 6, wherein the concentration of the water-soluble metal salt in the aqueous medium in the addition step is 0.2 to 40.0 mmol/L.

12. The method according to claim 6, wherein the pH of the aqueous medium when the water-soluble metal salt is added to the aqueous medium is 4.0 to 9.0.

* * * * *